US009476218B2

(12) United States Patent
Takahashi et al.

(10) Patent No.: US 9,476,218 B2
(45) Date of Patent: Oct. 25, 2016

(54) COLUMN BASE FITTING AND COLUMN BASE STRUCTURE USING IT

(71) Applicant: Hitachi Metals Techno, Ltd., Tokyo (JP)

(72) Inventors: Hideaki Takahashi, Tokyo (JP); Michio Itoh, Tokyo (JP); Hidenori Tanaka, Tokyo (JP); Hisatomo Mochiduki, Tokyo (JP)

(73) Assignee: SENQCIA CORPORATION (JP)

( * ) Notice: Subject to any disclaimer, the term of this patent is extended or adjusted under 35 U.S.C. 154(b) by 0 days.

(21) Appl. No.: 14/347,006

(22) PCT Filed: Sep. 25, 2013

(86) PCT No.: PCT/JP2013/075930

§ 371 (c)(1),
(2) Date: Mar. 25, 2014

(87) PCT Pub. No.: WO2014/050901

PCT Pub. Date: Apr. 3, 2014

(65) Prior Publication Data

US 2015/0191929 A1 Jul. 9, 2015

(30) Foreign Application Priority Data

Sep. 27, 2012 (JP) ..... 2012-215253
Sep. 27, 2012 (JP) ..... 2012-215254
Sep. 27, 2012 (JP) ..... 2012-215255

(51) Int. Cl.
*E02D 27/32* (2006.01)
*E04H 12/22* (2006.01)
(Continued)

(52) U.S. Cl.
CPC ..... *E04H 12/2261* (2013.01); *E02D 27/42* (2013.01); *E04B 1/2403* (2013.01);
(Continued)

(58) Field of Classification Search
CPC ..... E04C 3/30; E04B 1/4157; E04B 1/40; E04H 12/2261
USPC ..... 52/169.9, 699, 745.21, 745.17, 745.04, 52/295, 701, 298, 296, 297, 292
See application file for complete search history.

(56) References Cited

U.S. PATENT DOCUMENTS 4,048,776 A * 9/1977 Sato ..... 52/297
4,070,837 A * 1/1978 Sato ..... 52/297
(Continued)

FOREIGN PATENT DOCUMENTS

JP H09132941 A 5/1997
JP 2000008495 A 1/2000
(Continued)

*Primary Examiner* — Chi Q Nguyen
(74) *Attorney, Agent, or Firm* — Bacon & Thomas, PLLC

(57) ABSTRACT

A column base fitting 42 includes a bottom plate 42*c* and a support base 42*f*. The bottom plate 42*c* is formed to be a plate shape having a square shape, both surfaces of upper and lower, and thickness. The support base 42*f* is inside from the periphery part of an upper surface 42*d* of the bottom plate 42*c* and has a height upward. A lower end of column member 4 is jointed on an upper surface 42*g* of the support base 42*f*. Three bolt insertion holes 42*a*, 42*b* and 42*b* are formed in each four corner portions of the bottom plate 42*c*. A center position of three bolt insertion holes 42*a*, 42*b* and 42*b* is located at a position in which a gravity center of a triangle consisting of lines connecting each center of the insertion holes comes to a position corresponding to a corner part 42*q* of the support base 42*q*.

17 Claims, 31 Drawing Sheets

(51) Int. Cl.

| | |
|---|---|
| ***E04B 1/24*** | (2006.01) |
| ***E02D 27/42*** | (2006.01) |
| ***E04H 9/02*** | (2006.01) |
| *E04C 3/30* | (2006.01) |
| *E04B 1/41* | (2006.01) |

(52) U.S. Cl.
CPC ..... *E04H 9/021* (2013.01); *E04B 1/40* (2013.01); *E04B 1/4157* (2013.01); *E04B 2001/2451* (2013.01); *E04B 2001/2463* (2013.01); *E04C 3/30* (2013.01)

(56) References Cited

U.S. PATENT DOCUMENTS

| | | | | |
|---|---|---|---|---|
| 4,125,217 | A * | 11/1978 | Sato | 228/169 |
| 5,063,719 | A * | 11/1991 | Matsuo et al. | 52/296 |
| 5,505,033 | A * | 4/1996 | Matsuo et al. | 52/296 |
| 6,336,620 | B1 * | 1/2002 | Belli | 248/519 |
| 6,868,641 | B2 * | 3/2005 | Conner et al. | 52/98 |
| 6,988,700 | B2 * | 1/2006 | Cote | 248/519 |
| 7,722,014 | B2 * | 5/2010 | Godwin | 256/65.14 |
| 7,921,616 | B2 * | 4/2011 | Reyneveld | 52/295 |
| 8,826,629 | B1 * | 9/2014 | Brindle | 52/745.17 |
| 8,887,461 | B2 * | 11/2014 | Hemphill et al. | 52/296 |
| 9,004,439 | B2 * | 4/2015 | Gross et al. | 248/507 |
| 2007/0158526 | A1 * | 7/2007 | Platt | E04H 12/2261 248/519 |

FOREIGN PATENT DOCUMENTS

| | | | |
|---|---|---|---|
| JP | 2000282570 | A | 10/2000 |
| JP | 2003232078 | A | 8/2003 |
| JP | 2003336266 | A | 11/2003 |
| JP | 2005344289 | A | 12/2005 |
| JP | 2009275390 | A | 11/2009 |
| JP | 2012007382 | A | 1/2012 |

* cited by examiner

COLUMN BASE FITTING AND COLUMN BASE STRUCTURE USING IT

BACKGROUND OF THE INVENTION

1. Field of the Invention

The present invention relates to a column base fitting having a lower end of a column member of a construction structure fitted thereon and screwed with a top end of an anchor bolt protruding upward from in a base concrete, and a column base structure using it.

2. Description of the Conventional Art

FIGS. 28 and 29 are reference views explanting a first conventional column base fitting 6 and a first conventional column base structure 2 using it.

As illustrated in FIG. 28, the first conventional column base structure 2 includes a plate-shaped column base fitting 6, on which the lower end surface of a steel column 4 (column member) is jointed on the upper surface thereof by welding. The column base fitting 6 is provided on a base concrete 3 through a mortar 8.

An top end of an anchor bolt 10 penetrating the mortar 8 and protruding upward from in the base concrete 3, is inserted in bolt insertion holes 6*a* and 6*b* (refer to FIG. 29) of the column base fitting 6, and a female screw of a nut member 12 is screwed with a male screw formed on the anchor bolt 10. In such a way, the steel column 4 is stood and fixed on the base concrete 3 through the column base fitting 6 (for example, refer to Japanese Patent No. 4006503).

In addition, in the conventional column base structures, for example, Japanese Patent Application Laid-Open No. 2003-336266 discloses the column base structure including a column base fitting which includes a bottom plate and a support base. The support base is structured such that the center of an upper surface of the bottom plate protrudes upward higher than the periphery of the bottom plate, and a lower end surface of the steel column is jointed on an upper surface of the support base by welding.

In the column base structure according to the Japanese Patent Application Laid-Open No. 2003-336266, the top end of the anchor bolt penetrating the mortar from in the concrete base and protruding upward, is inserted in a bolt insertion hole formed in the thickness direction of the periphery portion of the bottom plate of the column base fitting. A male screw formed on the anchor bolt screws with a female screw of the nut member. In such a way, the steel column is stood and fixed on the base concrete through the column base fitting.

The column base fitting 6 in the first conventional column base structure is formed to be a plate shape having a metal square shape, both surfaces of upper and lower, and thickness, as illustrated in FIG. 29. The bolt insertion holes 6*a* and 6*b* are formed in total 12 holes. These bolt insertion holes 6*a* and 6*b* penetrate in the thickness direction of the plate shape (in the figure, the perpendicular direction to the drawing paper) and are formed to have an approximately same diameter respectively. One anchor bolt 10 is loosely inserted in each hole.

The bolt insertion hole 6*a* of the column base fitting 6 is formed at each four corner portions of the square shape of the column base fitting 6 one by one. Namely, each center position of the four bolt insertion holes 6*a* in the column base fitting 6 is located in parallel direction to two sides extending in the lateral direction in FIG. 29 and at a position apart by a length L1 from an imaginary line X in the vertical direction in the figure. The imaginary line X passes a center position of the column base fitting 6. Further, each center position of the four bolt insertion holes 6*a* in the column base fitting 6 is located in parallel direction to two sides extending in vertical direction in the figure and at a position apart by a length L1 from an imaginary line Y in the lateral direction. The imaginary line Y passes a center position of the column base fitting 6.

Each center position of the bolt insertion holes 6*b* in the column base fitting 6 is located at an equivalent position in the length direction between the bolt insertion holes 6*a* and 6*a*, which are both ends of each four sides of the square shape of the column base fitting 6. In other words, the center position of the bolt insertion hole 6*b* in the column base fitting 6 is located at two positions which trisect the line connecting the each center of the bolt insertion holes of 6*a* and 6*a*.

The center position of the bolt insertion hole 6*b* is located, for example, at a position apart by a length L1 from the imaginary line Y in the lateral direction in the figure in two sides extending in the vertical direction in FIG. 29. Further, the center position of the bolt insertion hole 6*b* is located at a position apart by a length L2 from the imaginary line X in the vertical direction in FIG. 29. The length L2 is the trisected length of L1. In two sides extending in the lateral direction in FIG. 29, the bolt insertion hole 6*b* is located in the position in the same length.

SUMMARY OF THE INVENTION

Problems to be Solved by the Invention

As illustrated in FIG. 28, when a load generating large bending moment M is applied to the steel column 4 in the first conventional column base structure 2, for example by an earthquake, etc., the bending moment M acts to lift up the right end part in the figure of the column base fitting 6. The bending moment M rotates the steel column 4 in the anti-clockwise direction around the rotation center O of the joint part of the steel column 4 and the column base fitting 6.

In opposition to this, tensile loads P1 and P2 generate in the anchor bolt 10. The anchor bolt 10 fixes the right side part in FIG. 28 from the rotation center O, in the column base fitting 6, by screwing the male part of the anchor bolt 10 with the female part of the nut member 12. Thus, the tensile load P1 and P2 generate as a reaction force for preventing to lift up the right side part in the figure of the column base fitting 6 by the bending moment M.

The tensile loads P1 and P2 generating as the reaction force increase as increasing the lengths L1 and L2, which is the length in the right direction in FIG. 28 from the rotation center O. Further, the tensile loads P1 and P2 increase as increasing the diameter size of the anchor bolt 10.

However, in the first conventional column base structure 2, the tensile load P2 is considerably smaller than the tensile load P1. The tensile load P2 generates in the anchor bolt 10, which is inserted and fixed in the bolt insertion hole 6*b* at the position apart by the length L2 in the right direction in FIG. 28 from the rotation center O. The tensile load P1 generates in the anchor bolt 10 which is inserted and fixed in the bolt insertion hole 6*a* at the position apart by the length L1 from the rotation center O.

Therefore, as for the tensile load generating in the anchor bolt 10 against the bending moment M (correlating to flexural capacity with respect to the bending moment M), there is the anchor bolt 10 which can generate only considerably small value of tensile load P2 as described above. Thus, there has been a problem that the entire tensile load, i.e., the flexural capacity of the column base structure 2 with respect to the bending moment M, decreases corresponding to the small value of tensile load P2.

Further, when the anchor bolt 10 having a large diameter is adopted in order to increase the tensile loads P1 and P2 generating in the anchor bolt 10 against the bending moment M, the size of the nut member 12 corresponding to the anchor bolt 10 increases. In addition, since it is also necessary to increase a thickness of the column base fitting 6, there is a problem that the column base fitting 6 leads the increase of size, weight, and cost.

Further, FIG. 30 and FIG. 31 are views for explaining the second conventional column base fitting 22 and the column base structure 20 different from the first conventional column base fitting 6 and the column base structure 2.

In the same parts in the first conventional column base fitting 6 and the column base structure 2, the same codes are added for explaining and the overlapping explanation about the same constitutions as the first conventional column base fitting 6 and the column base structure 2 is omitted excepting a part.

As illustrated in FIG. 30, the second conventional column base structure 20 is different from the first conventional column base structure 2 in a structure having another column base fitting 22 instead of the column base fitting 6 in the first conventional column base structure 2.

As illustrated in FIG. 31, the column base fitting 22 is a metal square plate having both surfaces of upper and lower, and thickness. The bolt insertion holes 22*a* and 22*b* penetrating in the thickness direction (the perpendicular direction to the paper drawing in the figure) are formed in total 12. These bolt insertion holes 22*a* and 22*b* are formed to have approximately the same diameter and one anchor bolt 10 is loosely inserted in the each hole.

Two bolt insertion holes 22*a* of the column base fitting 22 are formed at adjacent positions in the orthogonal direction with respect to each side, in each four corner portions of the square shape of column base fitting 22.

Namely, the center position of the bolt insertion hole 22*a* of the column base fitting 22 is located at a position apart by lengths L1 and L3 from an imaginary line X in the vertical direction in FIG. 31. The imaginary line X extends in the lateral direction in the figure and passes a center position of the column base fitting 22 in the vertical direction in the figure. Further, the center position of the bolt insertion hole 22*a* of the column base fitting 22 is located at a position apart by lengths L3 and L1 from an imaginary line Y in the vertical direction in the figure. The imaginary line Y extends in the vertical direction in the figure and passes a center position of the column base fitting 22 in the lateral direction in the figure. The center positions of the bolt insertion holes 22 are located above two positions.

The center position of the bolt insertion holes 22*b* is located at a position of the center position in the length direction of each four sides of the column base fitting 22 and close to the inside of the center portion. That is, for example, in the sides vertically extending in FIG. 31, the each center position of the bolt insertion holes 22*b* is located at a position apart by the length L1 in the lateral direction in the figure from the imaginary line Y, and on the imaginary line X.

Also in the second conventional column base structure 20, there is the same problem as the first conventional column base structure 2.

That is, as illustrated in FIG. 30, when the load generating the large bending moment M is applied to the steel column 4 in the second conventional column base structure 20, by for example, an earthquake, etc., tensile loads P1 and P3 generate in the anchor bolt 10 fixing the right side part in the column base fitting 22 in the figure, as reaction forces for preventing to lift up the right side portion of the column base fitting 22 in the figure. The large bending moment M rotates the steel column 4 in the anti-clockwise direction around the rotation center O at the joint part of the steel column 4 and the column base fitting 22.

However, in the second conventional column base structure 20, in the anchor bolt 10 inserted in the bolt insertion hole 22*b*, in which the center position thereof looked to be the same position as the rotation center O in the lateral direction in FIG. 30, the tensile load against the bending moment M does not generate.

Therefore, in the second conventional column base structure 20, there are the anchor bolts 10 not generating the tensile load depending on the direction of the bending moment M action. Thus, there is a problem that the entire tensile load, i.e., the flexural capacity of the column base structure 20 with respect to the bending moment M, decreases corresponding to the anchor bolts 10 not generating the tensile load.

In view of the above problems, the present invention is directed to provide the column base fitting, which can increase the flexural capacity of the entire column base structure and prevent the increase of size, weigh, and cost, and the column base structure using it.

Means to Solve the Problems

For solving the above problems, a column base fitting according to the present invention includes a bottom plate formed to be an approximately plate shape having a square shape, both surfaces of upper and lower, and thickness, and, a support base being inside from a periphery part of the upper surface of the bottom plate and having a height upward, wherein a lower end of a column member is jointed on an upper surface of the support base, wherein three bolt insertion holes are formed in each four corner portions of the bottom plate, wherein each center position of the three bolt insertion holes is located at a position, in which a gravity center of a triangle consisting of lines connecting each center of the bolt insertion holes comes to a position corresponding to a corner part of the support base, Further, the column base fitting according to the present invention, wherein the three bolt insertion holes are a first bolt insertion hole formed in each four corner portions of the bottom plate and second bolt insertion holes formed at positions closer to a center part than the first bolt insertion hole in each two adjacent sides to the corner portion.

Further, the column base fitting according to the present invention, wherein a step recess portion lower than a height of the bottom plate is formed on a lower surface side of the bottom plate and outside in the horizontal direction from the second bolt insertion hole.

Further, the column base fitting according to the present invention, wherein a center position of the first bolt insertion hole is located at a position shifted close to the corner part of the support base from a cross point of two lines. One line passes two centers of the second bolt insertion holes formed at two positions in the length direction of one side of the bottom plate. Another line passes two centers of the second bolt insertion holes formed at two positions in the length direction of another adjacent side to the one side in the perpendicular direction.

Further, the column base fitting according to the present invention, wherein a protrusion portion protruding outside in the approximately perpendicular direction from a side surface near a corner part of the support base is formed.

Further, for solving the above problems, a column base structure according to the present invention includes column base fitting including;

a bottom plate formed to be an approximately plate shape having a square shape, both surfaces of upper and lower, and thickness, a support base being inside from a peripheral part of the upper surface of the bottom plate and having a height upward, wherein a lower end of a column member is jointed on an upper surface of the support base, wherein three bolt insertion holes are formed in each four corner portions of the bottom plate, wherein each center position of the three bolt insertion holes is located at a position in which a gravity center of a triangle consisting of lines connecting each center of the three bolt insertion holes comes to a position corresponding to a corner part of the support base.

Further, for solving the above problems, a column base fitting according to the present invention includes, a column base fitting is formed to be a plate shape having a square shape, both surfaces of upper and lower, and thickness, wherein a lower end of a column member is jointed on the upper surface thereof, wherein three bolt insertion holes are formed in each four corner portions of the square shape, wherein each center position of the three bolt insertion holes is located at a position in which a gravity center of a triangle consisting of lines connecting each center of the three bolt insertion holes comes to a position corresponding to a corner part of the column member.

Further, in the column base fitting according to the present invention, three bolt insertion holes are a first bolt insertion hole formed in each four corner portions and second insertion holes formed at positions closer to a center part than the first bolt insertion hole in each two adjacent sides to the corner portion.

Further, in the column base fitting according to the present invention, a step recess portion having a height lower than a height from the upper surface to the lower surface is formed in the lower surface side of the column base fitting and outside in the horizontal direction from the second bolt insertion hole.

Further, in the column base fitting according to the present invention, the center position of the first bolt insertion hole is located at a position shifted close to the center of the square shape from a cross point of two lines. One line passes two centers of the second bolt insertion holes formed at two positions in the length direction of one side of the square shape. Another line passes two centers of the second bolt insertion holes formed at two positions in the length direction of another adjacent side to the one side in the perpendicular direction.

Further, for solving the above problems, a column base structure according to the present invention includes, a column base fitting formed to be a plate shape having a square shape, both surfaces of upper and lower, and thickness, wherein a lower end of a column member is jointed on the upper surface of the column base fitting, and wherein in the column base fitting, three bolt insertion holes are formed in each four corner portions of the square shape, and wherein each center position of the three bolt insertion holes is located at a position in which a gravity center of a triangle consisting of lines connecting each center of the three bolt insertion holes comes to a position corresponding to a corner part of the column member.

Further, in the column base structure according to the present invention, the column base fitting is provided upward on a base concrete and inserted in each there bolt insertion holes by an anchor bolt upward protruding from the base concrete.

Further, for solving the above problems, a column base fitting according to the present invention includes, a column base fitting formed to be a plate shape having a square shape, both surfaces of upper and lower, and thickness, wherein a lower end of a column member is jointed on the upper surface of the column base fitting, wherein the column base fitting is fixed upward on the base concrete by a holding member placed on the upper surface thereof, wherein three notch portions are formed in each four corner portions of the square shape, wherein each center position of the three notch portions is located at a position in which a gravity center of a triangle consisting of lines connecting each center of three circular arc portions comes to a position corresponding to a corner part of the column member.

Further, in the column base fitting according to the present invention, the three notch portions is formed to be approximately U shape having a circular arc portion at innermost part thereof.

Further, in the column base fitting according to the present invention, the three notch portions are a first notch portion formed in each four corner portions, and second notch portions formed at positions shifted close to a center part than the first notch portion in each two adjacent sides to the corner portion.

Further, the column base fitting according to the present invention, the center position of the circular arc portion of the first notch portion is located at a position shifted close to a center portion of the square shape from a cross point of two lines. One line passes two centers of the circular arc portions of the second notch portions formed at two positions in the length direction of one side of the square shape. Another line passes two centers of the circular arc portions of the second notch portions formed at two positions in the length direction of another adjacent side to the one side in the perpendicular direction.

Further, for solving the above problems, a column base structure according to the present invention includes, a column base fitting formed to be a plate shape having a square shape, both surfaces of upper and lower, and thickness, wherein a lower end of a column member is jointed on the upper surface of the column base fitting, and wherein the column base fitting is fixed upward on the base concrete by a holding member placed on the upper surface thereof, and wherein in the column base fitting, three notch portions are formed in each four corner portions of the square plate shape, and wherein each center position of the three notch portions is located at a position in which a gravity center of a triangle consisting of lines connecting each center of the three circular arc portions comes to a position corresponding to the corner part of the column member.

Further, in the column base structure according to the present invention, the column base fitting is provided upward on the base concrete, and anchor bolts protruding upward from the base concrete are inserted in each three notch portions, and the holding member is fixed on the column base fitting by the anchor bolts inserted in the three notch portions.

Effect of the Invention

According to the column base fitting of the present invention, the column base fitting includes the bottom plate formed to be the approximately plate shape having the square shape, both surfaces of upper and lower, and thickness, and, the support base being inside from the periphery part of the upper surface of the bottom plate and having the height upward.

In the column base fitting, the lower end of the column member is jointed on the upper surface of the support base, the three bolt insertion holes are formed in each four corner portions of the bottom plate, and each center position of the three bolt insertion holes is located at the position, in which the gravity center of the triangle consisting of lines connecting each center of the bolt insertion holes comes to the position corresponding to the corner part of the support base.

Taking such a constitution, the flexural capacity of the entire column base structure can increase, and the increase of size, weight, and cost can be prevented in the column base fitting.

Further, according to the column base structure of the present invention, the column base structure includes the column base fitting, the column base fitting including the bottom plate formed to be the approximately plate shape having the square shape, both surfaces of upper and lower, and thickness, the support base being inside from the peripheral part of the upper surface of the bottom plate and having the height upward, wherein the lower end of the column member is jointed on the upper surface of the support base.

In the column base fitting, the three bolt insertion holes are formed in each four corner portions of the bottom plate, each center position of the three bolt insertion holes is located at the position in which the gravity center of the triangle consisting of lines connecting each center of the three bolt insertion holes comes to the position corresponding to the corner part of the support base.

Taking such a constitution, the flexural capacity of the entire column base structure can increase, and the increase of size, weight, and cost can be prevented in the column base fitting.

Further, according to the column base fitting of the present invention, the column base fitting formed to be the plate shape having the square shape, both surfaces of upper and lower, and thickness, wherein the lower end of the column member is jointed on the upper surface thereof, in the column base fitting, three bolt insertion holes are formed in each four corner portions of the square shape, and each center position of the three bolt insertion holes is located at the position in which the gravity center of the triangle consisting of lines connecting each center of the three bolt insertion holes comes to the position corresponding to the corner part of the column member.

Taking such a constitution, the flexural capacity of the entire column base structure can increase, and the increase of size, weight, and cost can be prevented in the column base fitting.

Further, the column base structure according to the present invention, the column base structure includes the column base fitting formed to be the plate shape having the square shape, both surfaces of upper and lower, and thickness, wherein the lower end of the column member is jointed on the upper surface of the column base fitting, in the column base fitting, the three bolt insertion holes are formed in each four corner portions of the square shape, and each center position of the three bolt insertion holes is located at the position in which the gravity center of the triangle consisting of lines connecting each center of the three bolt insertion holes comes to the position corresponding to the corner part of the column member.

Taking such a constitution, the flexural capacity of the entire column base structure can increase, and the increase of size, weight, and cost can be prevented in the column base fitting.

Further, according to the column base fitting of the present invention, the column base fitting is formed to be the plate shape having the square shape, both surfaces of upper and lower, and thickness, wherein the lower end of the column member is jointed on the upper surface of the column base fitting, and the column base fitting is fixed upward on the base concrete by the holding member placed on the upper surface thereof, in the column base fitting, the three notch portions are formed in each four corner portions of the square shape, and each center position of the three notch portions is located at the position in which the gravity center of the triangle consisting of lines connecting each center of three circular arc portions comes to the position corresponding to the corner part of the column member.

Taking such a constitution, the flexural capacity of the entire column base structure can increase, and the increase of size, weight, and cost can be prevented in the column base fitting. In addition, the efficiency of the installation work of the column base structure can be increased.

Further, according to the column base structure of the present invention, the column base structure includes the column base fitting formed to be the plate shape having a square shape, both surfaces of upper and lower, and thickness, wherein the lower end of the column member is jointed on the upper surface of the column base fitting, and the column base fitting is fixed upward on the base concrete by the holding member placed on the upper surface thereof, in the column base fitting, the three notch portions are formed in each four corner portions of the square plate shape, and each center position of the three notch portions is located at the position in which the gravity center of the triangle consisting of lines connecting each center of the three circular arc portions comes to the position corresponding to the corner part of the column member.

Taking such a constitution, the flexural capacity of the entire column base structure can increase, and the increase of size, weight, and cost can be prevented in the column base fitting. In addition, the efficiency of the installation work of the column base structure can be increased.

DETAILED DESCRIPTION OF PREFERRED EMBODIMENT

The exemplary embodiments of the column base fitting according to the present invention and the column base structure using it will be described in detail based on drawings as follows.

FIGS. 1 to 11 are views explaining a column base fitting 42 and a column base structure 40 using it according to the first exemplary embodiment of the present invention.

Figure 1:
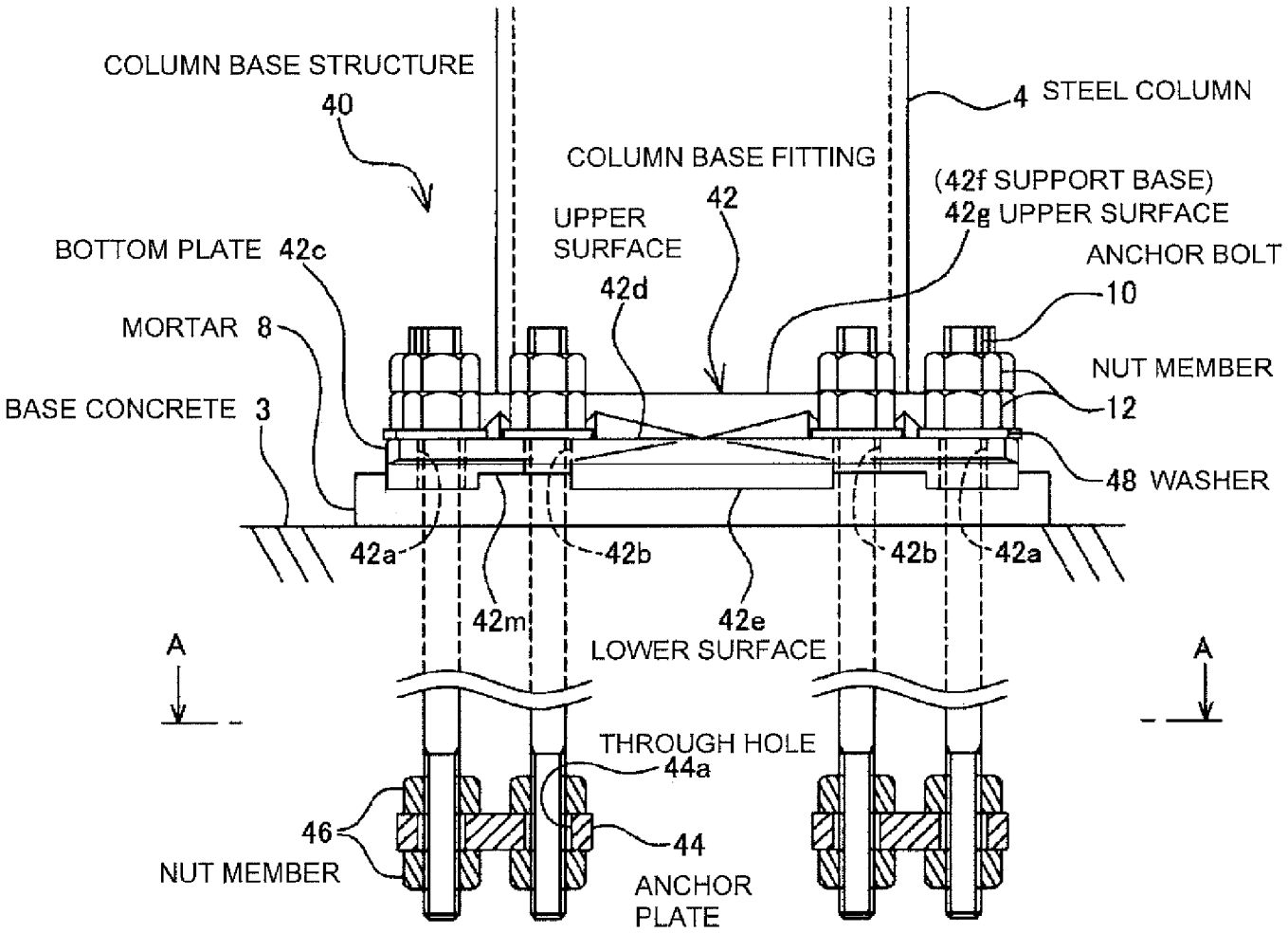
FIG. 1 is a partial cross-sectional side view illustrating a column base structure 40 according to the first exemplary embodiment of the present invention.
Figure 3:
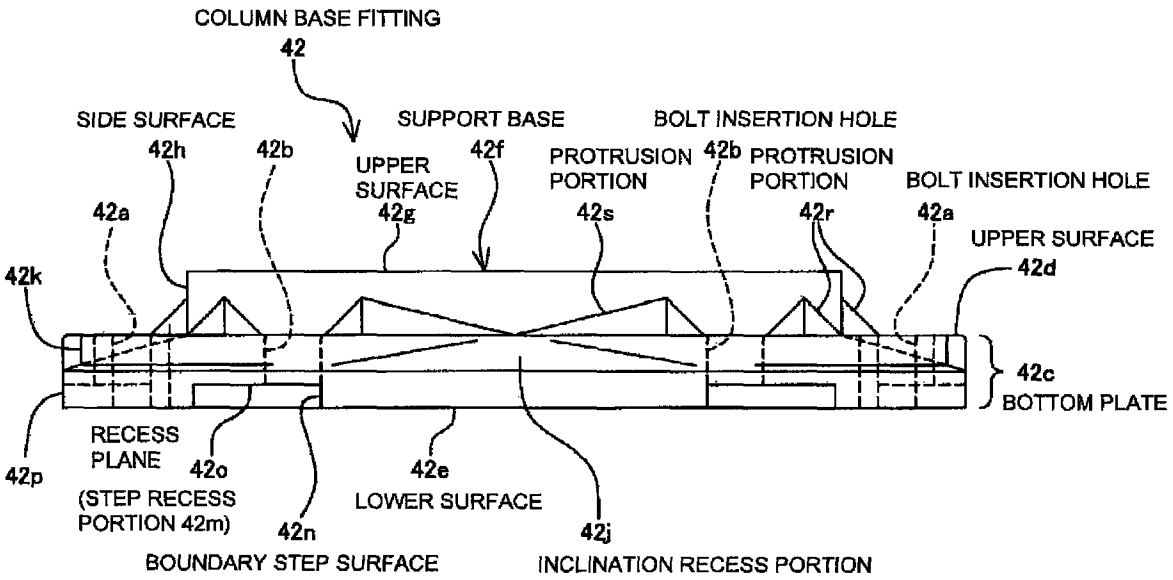
FIG. 3 is a side view of the column base fitting 42 illustrated in FIG. 2.

As illustrated in FIG. 1, the column base structure 40 includes the column base fitting 42. The column base fitting 42 is provided upward on a base concrete 3 through a mortar 8. Further, as illustrated in FIG. 3, the column base fitting 42 includes a bottom plate 42*c* and support base 42*f*. A lower end of a steel column 4 formed to be a rectangular tube having a length in the vertical direction in the figure is jointed on an upper surface 42*g* of the support base 42*f* by welding.

An upper end of an anchor bolt 10 penetrating the mortar 8 from in the base concrete 3 and protruding upward is inserted in a bolt insertion holes 42*a* and 42*b* formed in a bottom plate 42*c* of the column base fitting 42.

A male screw part is formed at the upper end of the anchor bolt 10 and protrudes upward from the peripheral part of the bottom plate 42*c* of the column base fitting 42. The male screw part is inserted in the through hole, which is not illustrated, of a washer 48, and screwed with female screw parts of two nuts 12 (double nut). By this constitution, the steel column 4 is stood and fixed on the base concrete 3 through the column base fitting 42 and the mortar 8.

Figure 2:
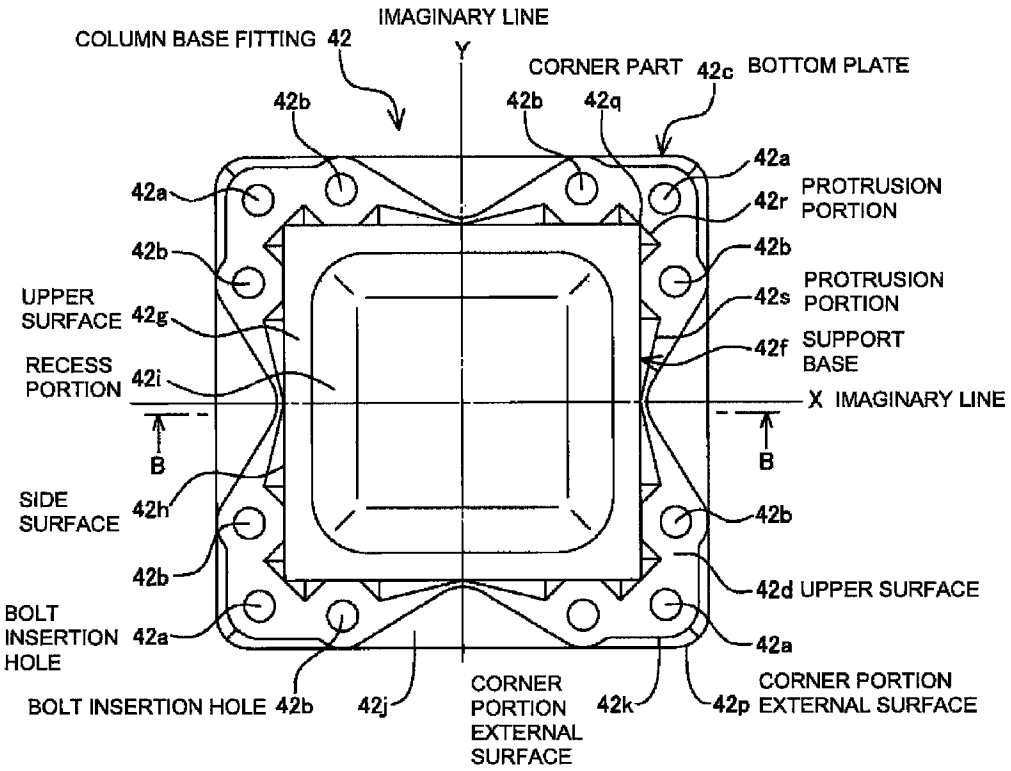
FIG. 2 is a top view of a column base fitting 42 in the column base structure 40 illustrated in FIG. 1.

As illustrated in FIGS. 2 and 3, the column base fitting 42 is made of a metal, and includes the bottom plate 42*c* and the support base 42*f*. The bottom plate 42*c* is formed to be an approximately plate shape having a square shape, both surfaces of upper and lower, and thickness. The support base 42*f* is inside (in the center side) the peripheral portion of an upper surface 42*d* of the bottom plate 42*c* and has a height upward in FIG. 3. These bottom plate 42*c* and support base 42*f* are integrally formed by casting, together with protrusion portions 42*r* and 42*s*, which are described later.

Figure 4:
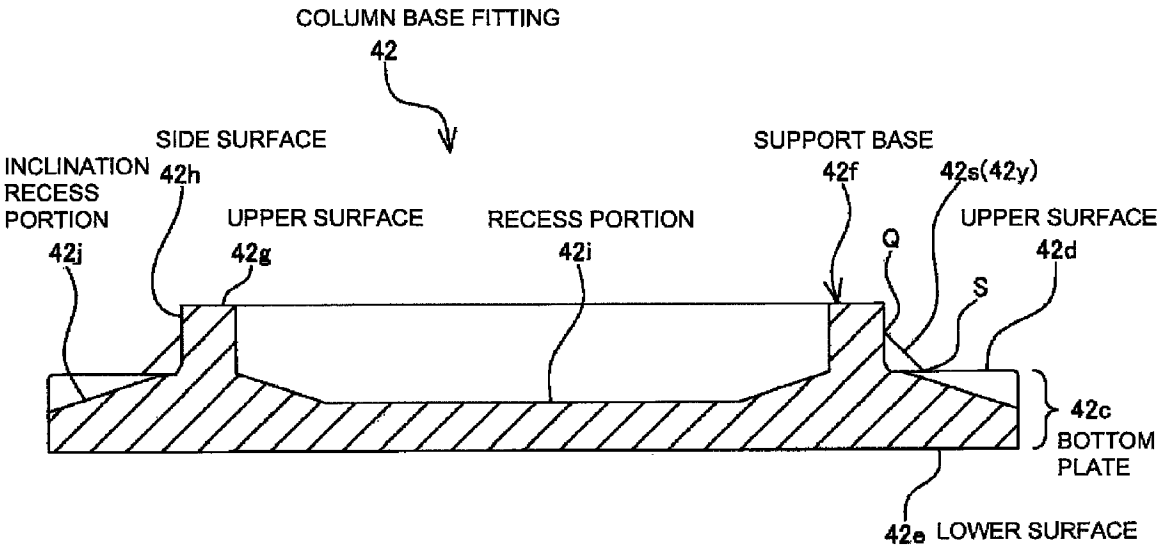
FIG. 4 is a cross-sectional view taken along a line B-B in the column base fitting 42 illustrated in FIG. 2.

As illustrated in FIG. 2, the support base 42*f* of the column base fitting 42 is formed into a square shape which is slightly bigger than a square shape of the lower end of the steel column 4. As illustrated in FIG. 4, a recess portion 42*i* recessed downward in the figure is formed inside (in the center side) from an upper surface 42*g* of the support base 421 which has a square annular shape and a width in the perpendicular direction to each side of the support base 42*f*.

The upper surface 42*g* of the support base 42*f* is formed smoothly, and the steel column 4 is placed and jointed on the upper surface 42*g*.

In four corner portions of the bottom plate 42*c* of the column base fitting 42, which are illustrated in FIG. 2, a corner portion external surface 42*k* is recessed toward the center part of the column base fitting 42 from a corner portion external surface 42*p* positioned at the lower side in the figure. The height from the lower end of the corner portion external surface 42*k* to the lower end of the corner portion external surface 42*p* is formed to be lower than the height from the upper surface 42*d* to the lower surface 42*e* of the bottom plate 42*c*.

Further, in the bottom plate 42*c*, an inclination recess portion 42*j* is formed to be a triangle shape as illustrate in FIG. 2 at the center part in the length direction of each four sides. As illustrated in FIG. 4, in the inclination recess portion 42*j*, the height of the bottom plate 42*c* decreases gradually as approaching to the outer side surface of side part from the height of the inside of the upper surface 42*d* of the bottom plate 42*c*.

Namely, as illustrated in FIG. 2, the inclination recess portion 42*j* is formed to be a triangle area surrounded by three lines connecting three positions. In three positions, two positions are determined as follows. That is, in each four side parts of the bottom plate 42*c*, when the positions of two bolt insertion holes 42*b* and 42*b* are shifted in the parallel direction to the imaginary line X or Y to the side part, the reached points on the side part are the two positions. The other one point is at the center of the length of the side surface 42*h* of the support base 42*f* in parallel direction to the side part and close to the boundary of the bottom plate 42*c* and support base 42*f*.

As illustrated in FIG. 2, in the bottom plate 42*c*, the bolt insertion holes 42*a* (first bolt insertion hole) and the bolt insertion hole 42*b* (second bolt insertion hole) are formed in total 12. Three holes are formed at each four corner portions respectively. These holes are formed penetrating in the height direction of the bottom plate 42*c* (the perpendicular direction to the drawing paper in the figure). The each diameter of these holes is formed to be an approximately same, and one anchor bolt 10 is loosely inserted in each hole.

The bolt insertion hole 42*a* is formed close to each four corner portions of the square shape of the bottom plate 42*c* one by one.

Further, the center position of the bolt insertion hole 42*b* is located at a position, which is closer to the center of the each length of the four side parts than the bolt insertion hole 42*a* in the corner portion, in the both ends in each four side parts of the square shape of the bottom plate 42*c*.

Figure 5:
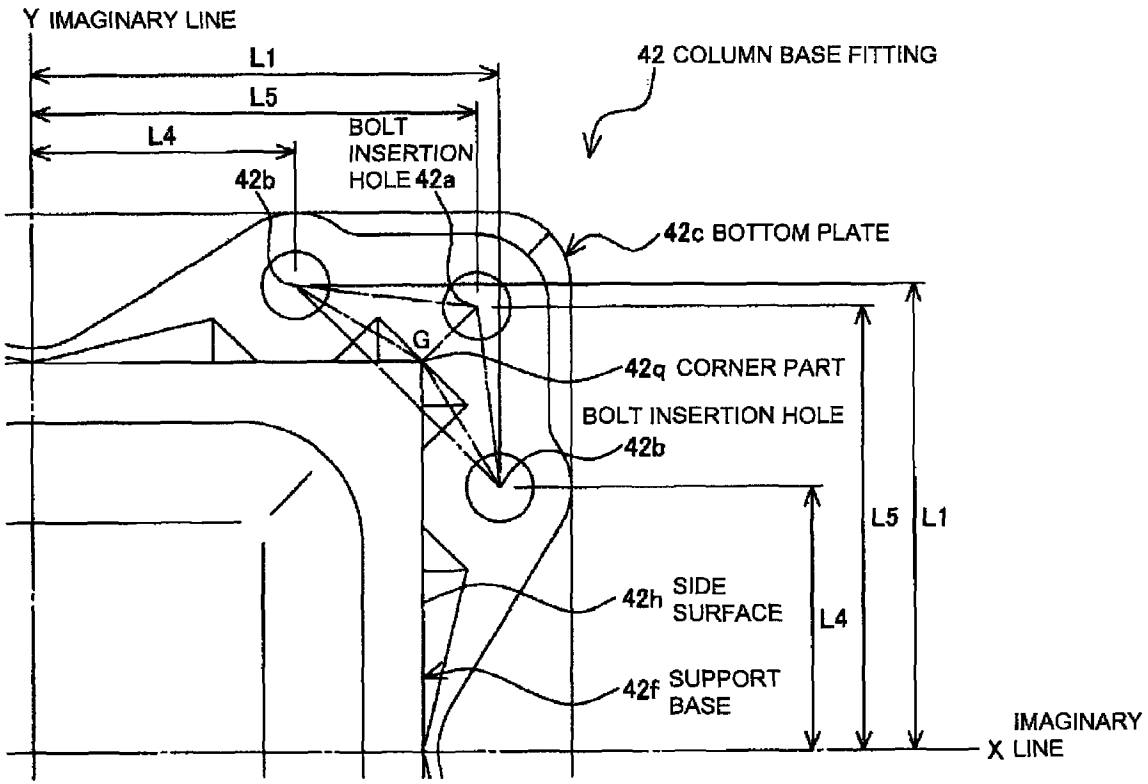
FIG. 5 is a view enlarging the upper right part of the column base fitting 42 illustrated in FIG. 2, that is, a partially enlarged top view for explaining each position of bolt insertion holes 42*a* and 42*b*.

Namely, as illustrated in FIG. 5, the center position of the bolt insertion hole 42*a* is located at each four positions (four corner portions). The four positions are determined as follows. That is, the position is apart by the length L5, which is shorter than the length L1, in the vertical direction in the figure, from the imaginary line X (the center line in the horizontal direction in the figure). Further, the position is apart by the length L5, which is shorter than the length L1, in the lateral direction in the figure, from the imaginary line Y (the center line in the vertical direction in the figure). The imaginary line X extending in the lateral direction in the figure passes the center position in the vertical direction in the figure of the column base fitting 42. The imaginary line Y extending in the vertical direction in the figure passes the center position in the lateral direction in the figure of the column base fitting 42.

For example, in the side part extending in the vertical direction in the figure of the column base fitting 42, the center position of the bolt insertion hole 42*b*, which is right side in FIG. 5, is located at a position apart by the length L1 in the right direction in the figure from the imaginary line Y. Further, the center position of the bolt insertion hole 42*b* is located at a position apart by the length L4 in the vertical direction in the figure from the imaginary line X.

Further, in the each bolt insertion hole 42*b*, the center position thereof is located at the position approximately the same length from the imaginary line X and the imaginary line Y, in the each four side parts of the bottom plate 42*c*.

As illustrated in FIG. 5, the bolt insertion hole 42*a* formed at the corner portion of the bottom plate 42*c* and two bolt insertion holes 42*b* adjacent both sides of the bolt insertion hole 42*a*, consist of a triangle by lines connecting each center position on the horizontal plane. The each center position of the bolt insertion holes 42*a*, 42*b* and 42*b* is located at the position in which the gravity center G of the triangle comes to a position corresponding to the corner part 42*q* of the support base 42*f*.

Three anchor bolts 10 inserted in the bolt insertion hole 42*a* and two insertion bolts 42*b* similarly consist of a triangle by lines connecting each center position on the horizontal plane. The each center position of the anchor bolts 10 is located at a position in which the gravity center G1 of the triangle (refer to FIG. 6) comes to the position corresponding to the corner part 42*q* of the support base 42*f*.

Therefore, the gravity center G1 of the three anchor bolts 10 inserted in the bolt insertion hole 42*a* and two bolt insertion holes 42*b* are located the same or similar position of the gravity center G of the bolt insertion hole 42*a* and two bolt insertion holes 42*b*.

The column base fitting 42 transmits the force generated in the steel column 4 by an earthquake, etc., to the base concrete 3 through the bottom plate 42*c* and the anchor bolt 10. A thickness t of the bottom plate 42*c* of the column base fitting 42 illustrated in FIG. 6 is designed to withstand the predetermined bending stress.

Figure 6:
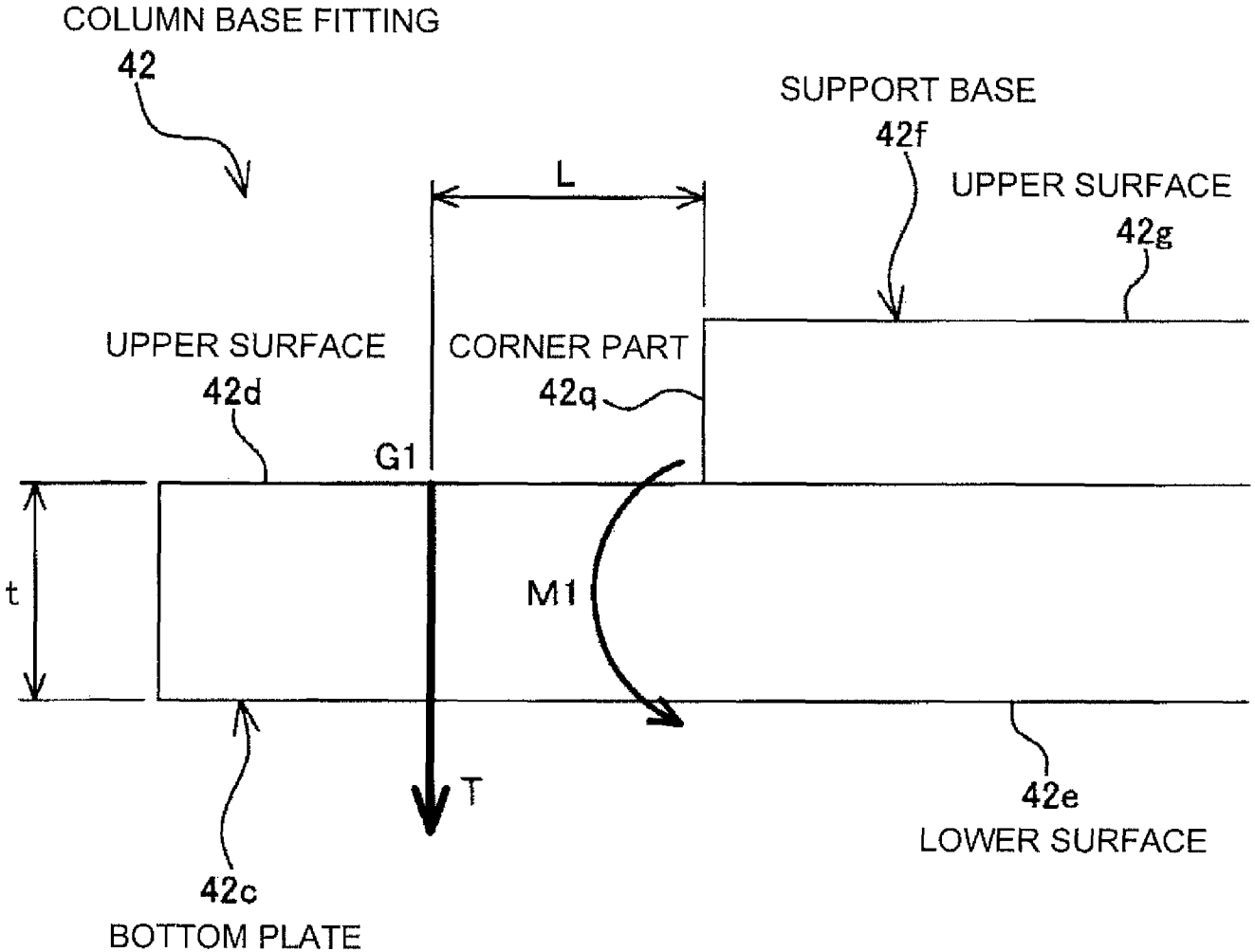
FIG. 6 is a conceptual side view for explaining a state in which the tensile load T is applied to the column base fitting 42 in the column base structure 40 illustrated in FIG. 1.

As illustrated in FIG. 6, when the bending moment M (refer to FIG. 10) is applied by an earthquake, etc., the tensile load T, which is a resultant force, acts on the gravity center G1 of the three anchor bolts 10 in the bottom plate 42*c* of the column base fitting 42. Here, the tensile load T is the resultant force generating in three anchor bolts 10 inserted in the bolt insertion hole 42*a* and two bolt insertion holes 42*b*.

At this time, a bending moment M1 generates at the lower end position in height of the corner part 42*q* of the support base 42*f* of the column base fitting 42. The bending moment M1 is proportional to the tensile load T and the length from the gravity center G1 of the three anchor bolt 10 to the lower end position in height of the corner part 42*q* of the support base 42*f*.

The thickness t is designed considering the bending moment M1 applied to the bottom plate 42*c*.

In the column base structure 40 according to the present exemplary embodiment, the gravity center G1 of the three anchor bolts 10 on the horizontal plane is located at the position corresponding to the corner part 42*q* of the support base 42*f*. The three anchor bolts 10 are inserted in the bolt insertion hole 42*a* and two bolt insertion holes 42*b* of the bottom plate 42*c* of the column base fitting 42. Thus, the length L from the gravity center G1 of the anchor bolt 10 to the lower end position in height of corner part 42*q* of the support base 42*f* can be remarkably short so as to approach to approximately zero.

By making the distance L from the gravity center G1 of the anchor bolt 10 to the lower end position in height of corner part 42*q* of the support base 42*f* to be remarkably short, the bending moment M1 can be remarkably small. Thus, the thickness t of the bottom plate 42*c* of the column base fitting 42 can be thin.

Therefore, in the column base structure 40 according to the present exemplary embodiment, since the thickness t of the bottom plate 42*c* of the column base fitting 42 can be thin, the present invention can prevent the increase of size, weight, and cost of the column base fitting 42.

Figure 7:
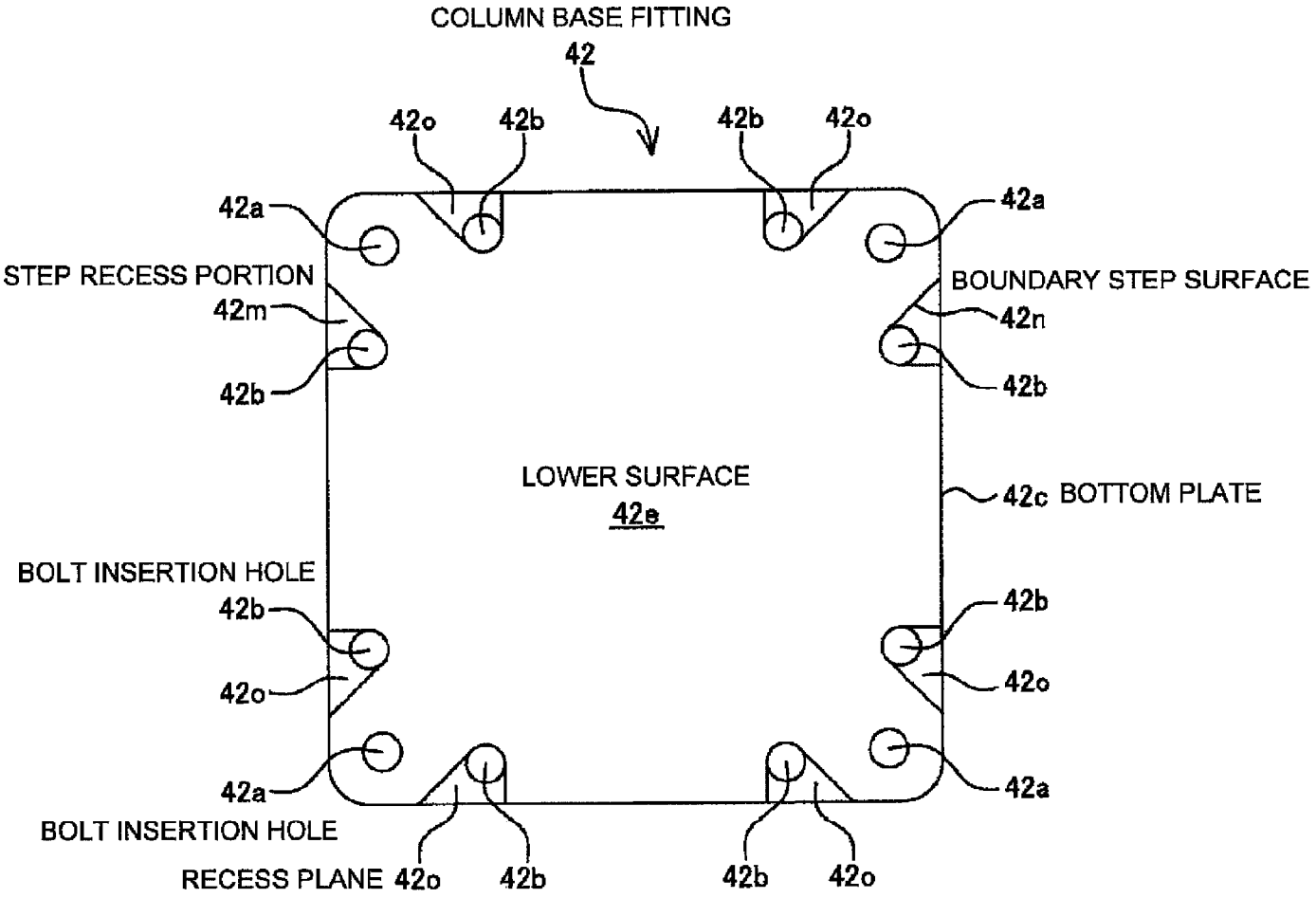
FIG. 7 is a bottom view of the column base fitting 42 illustrated in FIG. 2.

As illustrated in FIG. 7, in the bottom plate 42*c* of the column base fitting 42, a step recess portion 42*m* having a recess plane 42*o* recessing toward the back side of the drawing paper in the figure from a lower surface 42*e* (back surface) is formed at each four corner portions of the lower surface 42*e*. The height of an area of the step recess portion 42*m* of the column base fitting 42 is formed lower than the height from the lower surface 42*e* to an upper surface 42*d* of the bottom plate 42*c* (refer to FIG. 3).

A boundary step surface 42*n* is formed at a step portion of the recess plane 42*o* of the step recess portion 42*m* and the lower surface 42*e*. In the boundary step surface 42*n*, the center part of the length thereof contacts an inner periphery surface of the bolt insertion hole 42*b* and the both end parts of the length thereof extend outward.

Therefore, the step recess portion 42*m* is formed to have an approximately triangle shape opening from the bolt insertion hole 42*b* toward the outside.

In the column base structure 40 according to the present exemplary embodiment, a recess portion 42*i* and an inclination recess surface portion 42*j* illustrated in FIG. 4, an corner portion external surface 42*k* and 42*p* illustrated in FIGS. 2 and 3, and the step recess portion 42*m* illustrated in FIG. 7 are formed in the column base fitting 42. Thus, the column base structure 40 according to the present exemplary embodiment can prevent the increase of size, weight, and cost of the column base fitting 42.

Further, in the column base structure 40 according to the present exemplary embodiment, the step recess portion 42*m* and the boundary step surface 42*n* are formed in the column base fitting 42. Thus, even when a horizontal force (refer to FIG. 8) is applied to the column base fitting 42, it can be prevented that the column base fitting 42 shifts in the horizontal direction. The horizontal force F is generated by the sharing stress acting to a horizontal surface of the steel column 4, simultaneously with the bending moment M due to earthquake, etc.

Figure 8:
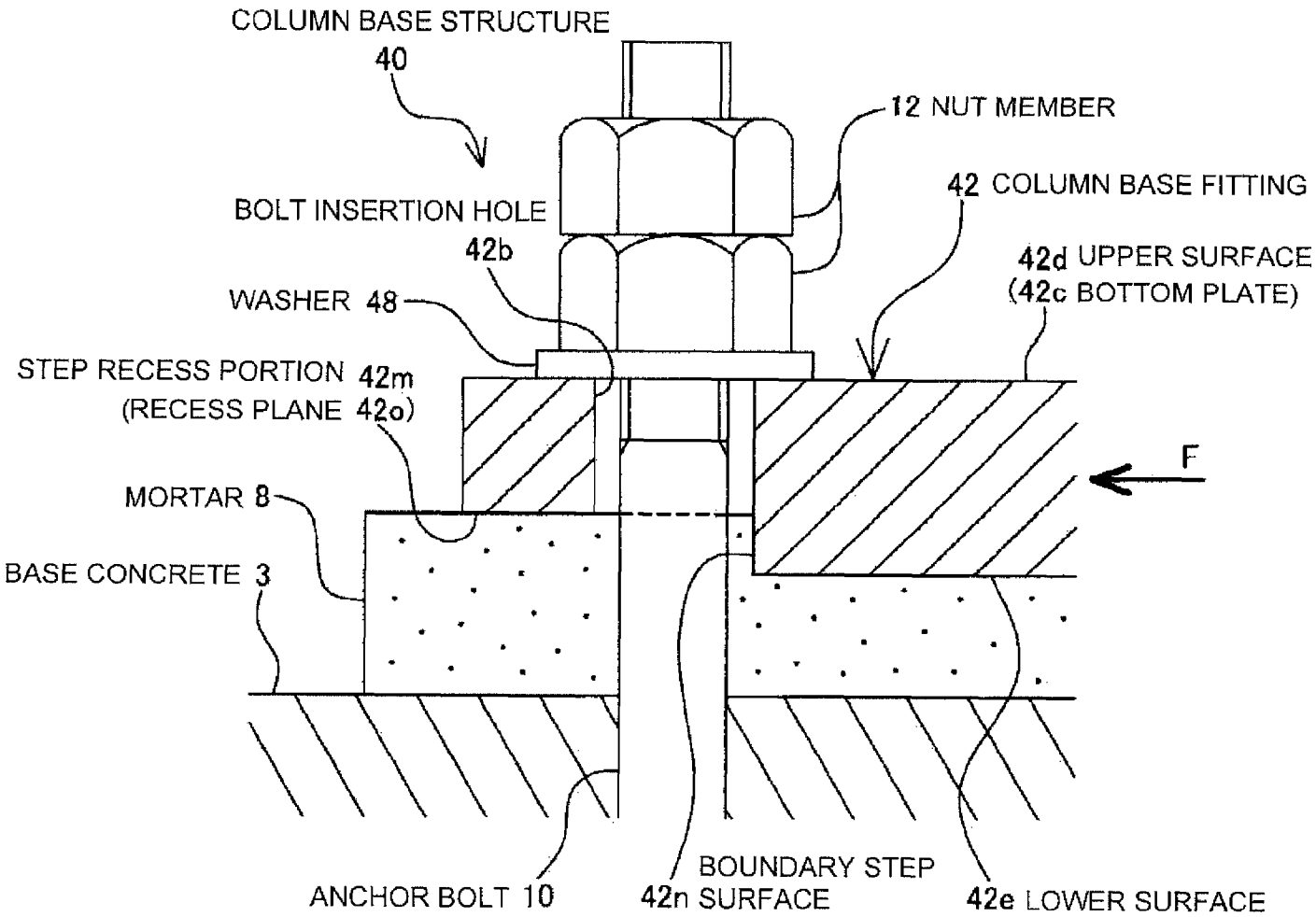
FIG. 8 is a partially enlarged cross-sectional view enlarging a joint part of an anchor bolt 10 and the column base fitting 42 in the column base structure 40 illustrated in FIG. 2.

Namely, as illustrated in FIG. 8, the mortar 8 filled between the lower surface 42*e* of the column base fitting 42 and the base concrete 3 tightly contacts the recess plane 42*o* of the step recess portion 42*m* and the boundary step surface 42*n*. In addition, the mortar 8 also tightly contacts a part of the outer peripheral surface of the anchor bolt 10 inserted in the bolt insertion hole 42*b*. Thus, the mortar 8 is filled between the recess surface 42*o* of the step recess portion 42*m* and the base concrete 3 for fulfilling the above conditions.

Therefore, as illustrated in FIG. 8, when the shearing stress acts to the steel column 4 by an earthquake, etc., the horizontal force F directing to left side in the figure is applied to the column base fitting 42. In such a case, the boundary step surface 42*n* of the column base fitting 42 acts so as to push each several anchor bolts 10 corresponding to the horizontal force F in the downstream side of the direction of horizontal force F, through the mortar 8. As the result of this, the horizontal force F is transmitted to the several anchor bolts 10.

The several anchor bolts 10 exhibits resistance force with respect to the horizontal force F, so that it can be prevented that the column base fitting 42 shifts in the horizontal direction with respect to the base concrete 3.

Furthermore, since the anchor bolts 10 receives the horizontal force F applied to the column base fitting 42 and exhibits the resistance force, it can be prevented that the horizontal force F is directly received by the mortar 8 only and thereby the mortar 8 is broken.

As illustrated in FIGS. 7 and 8, the step recess portion 42*m* of the column base fitting 42 is formed to have a shape opening from the bolt insertion hole 42*b* to the outside, so that the mortar 8 can be easily filled between the column base fitting 42 and the base concrete 3.

Figure 9:
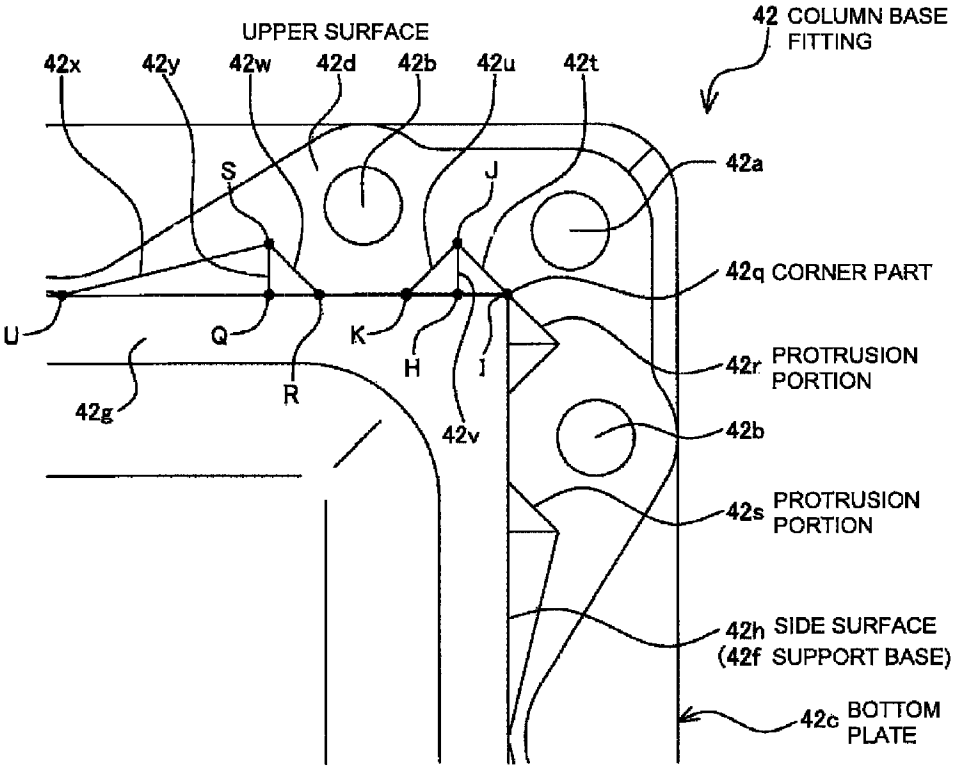
FIG. 9 is a view enlarging the upper right part of the column base fitting 42 illustrated in FIG. 2, that is, a partially enlarged top view for explaining each position of the protrusion portions 42*r* and 42*s*.

As illustrated in FIGS. 2 and 9, protrusion portions 42*r* and 42*s* are formed for increasing a cross-sectional surface in the perpendicular cross-section of the bottom plate 42*c*, between each side surface 42*h* of four sides of the support base 42*f* of the column base fitting 42 and the upper surface 42*d* of the bottom plate 42*c*.

Namely, as illustrated in FIG. 2, at two places of both ends in the length direction of the side surface 42*h* of the support base 42*f*, a protrusion portion 42*r* having an approximately triangular pyramid shape is formed. As illustrated in FIG. 3, the protrusion portion 42*r* protrudes in the approximately perpendicular direction outward from the side surface 42*h* and over from the intermediate position in height of the side surface 42*h* of the support base 42*f* to the upper surface 42*d* of the bottom plate 42*c*.

The protrusion portion 42*r* is formed to be an approximately triangle pyramid having four apexes H, I, J, and K as illustrated in FIG. 9. The protrusion portion 42*r* has a corner point (apex I), a ridge side portion 42*t*, an apex K, and a ridge side portion 42*u*. The corner point (apex I) is located at the lower end in height of the corner part 42*q*. The ridge side portion 42*t* protrudes outward from the side surface 42*h* and connects the apex J on the upper surface 42*d* of the bottom plate 42*c*. The apex K is located in the opposite side of the apex I with respect to an apex H described later and at the lower end position in height of the side surface 42*h*. The ridge side portion 42*u* protrudes outward from the side surface 42*h* and connects the apex J.

The each of the ridge side portion 42*t* and the ridge side portion 42*u* of the protrusion portion 42*r* are formed symmetrically each other centering a ridgeline 42*v*. The ridgeline 42*v* connects the apex H and the apex J. The apex H is located at the intermediate position of the height of the side surface 42 *h* (the same height of the apex Q in FIG. 4) of the support base 42*f*. The ridgeline 42*v* inclines about 45 degrees from the apex J on the upper surface 42*d* of the bottom plate 42*c*.

In the ridge side portion 42*u* of the protrusion portion 42*r*, the length size in the shortest distance from the center position of the bolt insertion hole 42*b* is set to be the same length size from the position of the apex I to the center position of the bolt insertion hole 42*a*.

Further, as illustrated in FIG. 2, at two places close to the center part from both ends in the length direction of the side surface 42*h* of the support base 42*f*, a protrusion portion 42*s* having an approximate triangular pyramid shape is formed. The protrusion portion 42*s* protrudes outward in the approximately perpendicular direction from the side surface 42*h* and over from the intermediate position in height of the side surface 42*h* of the support base 42*f* to the upper surface 42*d* of the bottom plate 42*c*.

The protrusion portion 42*s* is formed to be as asymmetric triangle pyramid having four apexes Q, R, S and U, as illustrated in FIG. 9. The protrusion portion 42*s* has an apex U, a ridge side portion 42*x*, an apex R, and a ridge side portion 42*w*. The apex U is located at the lower end in height of the center part in the length direction of the side surface 42*h* of the support base 42*f*. The ridge side portion 42*x* protrudes outward from the side surface 42*h* and connects the apex S (refer to FIG. 4) on the upper surface 42*d* of the bottom plate 42*c* and the apex U. The apex R is located in the opposite side of the apex U with respect to an apex Q, which is described later, and at the lower end of the height of the side surface 42*h*. The ridge side portion 42*w* protrudes outward from the side surface 42*h* and connects the apex S and apex R.

Each of the ridge side portion 42*w* and ridge side portion 42*x* in the protrusion portion 42*s* is formed at both sides of the ridgeline 42*y* and asymmetry concerning a ridgeline 42*y* so as to have a shape in which the ridge side portion 42*x* is longer than the ridge side portion 42*w*. The ridgeline 42*y* connects the apex Q and the apex S. The apex Q is located at the intermediate position in height of the side surface 42*h* (refer to FIG. 4) of the support base 42*f*. The ridgeline 42*y* inclines about 45 degrees from the apex S on the upper surface 42*d* of the bottom plate 42*c*.

In the ridge side portion 42*w* of the protrusion portion 42*s*, the length size in the shortest distance from the center position of the bolt insertion hole 42*b* is set to be the same length size from the lower end position in height of the corner part 42*q* of the support base 42*f* to the center position of the bolt insertion hole 42*a*.

In the column base structure 40 according to the present exemplary embodiment, the protrusion portion 42*r* and the protrusion portion 42*s* are formed in the column base fitting 42. Thus, the rigidity at the lower end position in height of the side surface 42*h* of the support base 42*f* in the bottom plate 42*c* can increase only necessary size at a necessary position.

Increasing the rigidity at a low rigidity position in the column base fitting 42 by the protrusion portion 42*r* and the protrusion portion 42*s*, the thickness of the bottom plate 42*c* can be thinned than the thickness of the bottom plate of the column base fitting, in which the protrusion portion 42*r* and the protrusion portion 42*s* are not formed.

Further, in the column base fitting 42, the length sizes of the shortest distance from the center position of the bolt insertion hole 42*b* to the ridge side portion 42*u* of the protrusion portion 42*r* and to the ridge side portion 42*w* of the protrusion portion 42*s* are formed to be the same length size from the lower end position in height of the corner part 42*q* of the support base 42*f* to the center position of the bolt insertion hole 42*a*, in the shortest distance. Thus, it can be prevented that high stress locally acts a part of the bottom plate 42*c*.

Therefore, in the column base structure 40 according to the present exemplary embodiment, since the protrusion portion 42*r* and the protrusion portion 42*s* are formed in the column base fitting 42, the bending strength of the entire column base structure 40 can be increased, and the increase of size, weight, and cost of the column base fitting 42 can be prevented.

Figure 11:
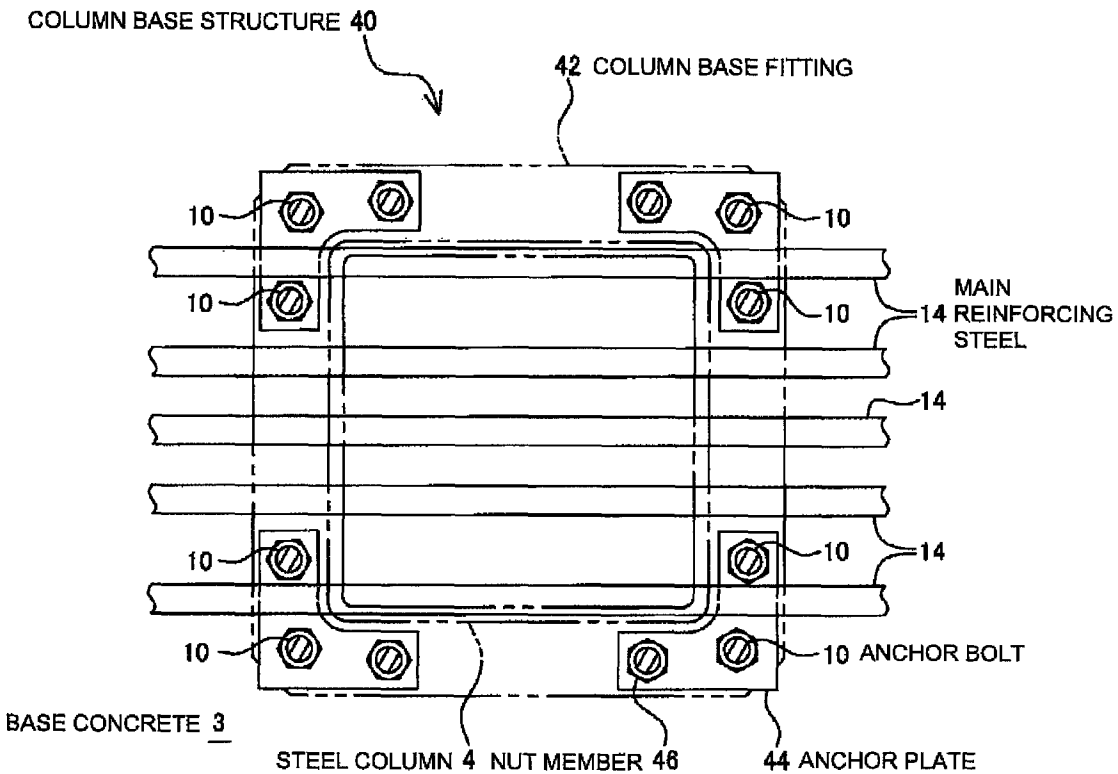
FIG. 11 is a cross-sectional view taken along a line A-A in the column base structure 40 illustrated in FIG. 1.

As illustrated in FIGS. 1 and 11, in the column base structure 40 according to the present exemplary embodiment, three anchor bolts 10 inserted in one bolt insertion hole 42*a* and two insertion holes 42*b* are fixed to one anchor plate 44 at the each lower end thereof in the base concrete 3.

As illustrated in FIG. 11, the anchor plate 44 is formed to have a L shaped plate. As illustrated in FIG. 1, in the anchor plate 44, the anchor bolt 10 is loosely inserted in a through hole 44*a* penetrating in the thickness direction. The nut member 46 is screwed with the anchor bolt 10 in the upper surface side and the lower surface side of the anchor plate 44, and thereby the anchor plate 44 is integrally fixed to the lower end of the anchor bolt 10 in the base concrete 3.

In the column base structure 40 according to the present exemplary embodiment, three anchor bolts 10 are attached to one anchor plate 44. Thus, the three anchor bolts 10 together can be fixed in the base concrete 3 and thus the attaching operation of the anchor bolts 10 can be easily performed.

Figure 10:
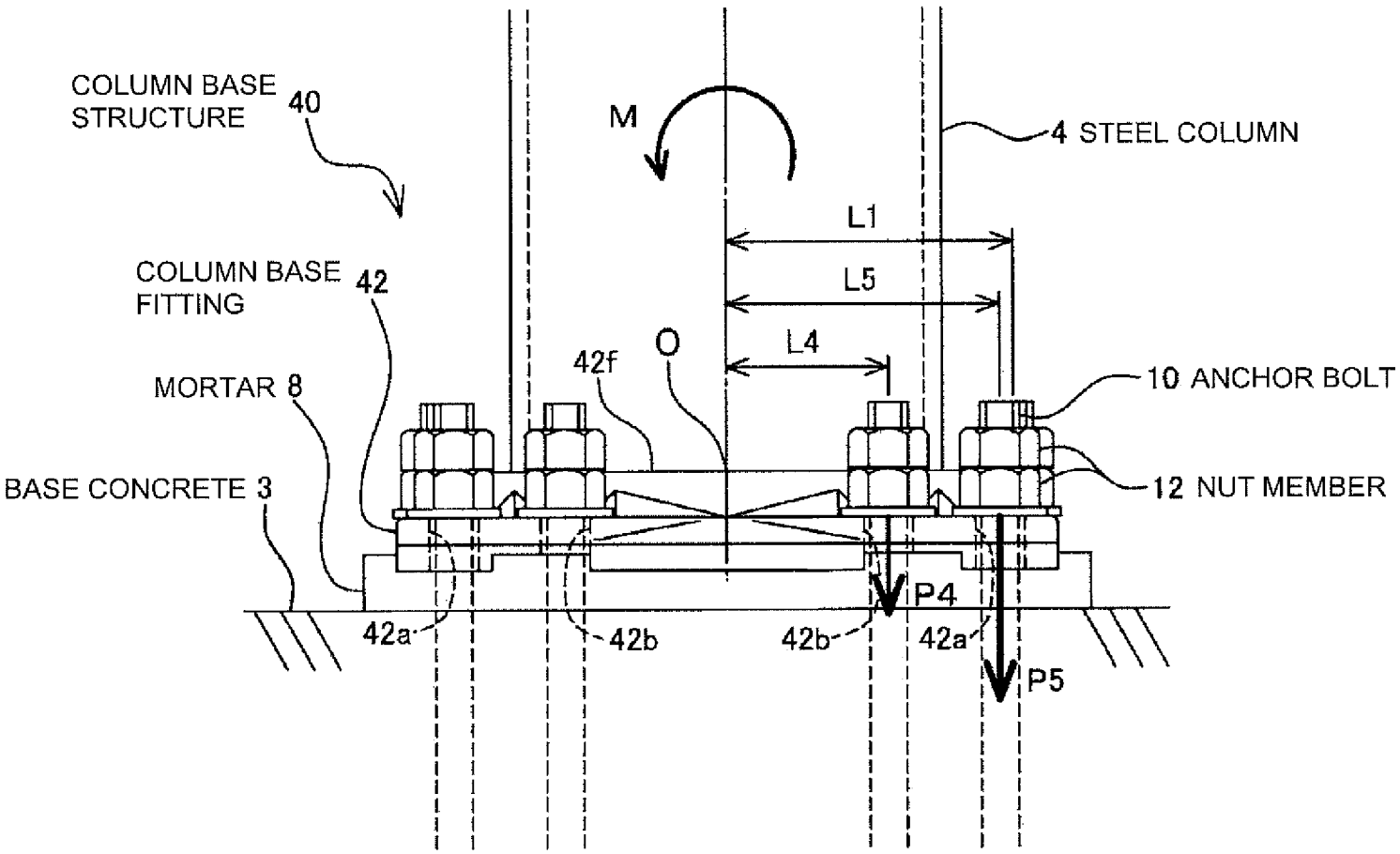
FIG. 10 is conceptual side view for explaining a state in which the bending moment M is applied in the column base structure 40 illustrated in FIG. 1.

In the column base structure 40 according to the present exemplary embodiment, as illustrated in FIG. 10, when a load generating large bending moment M is applied with respect to the steel column 4 of the column base structure 40, tensile loads P5 and P4 generate as reaction forces. The load generating the large bending moment M is applied at around of the rotation center O of the joint portion of the column base fitting 42 and the steel column portion 4, in the anti-clockwise direction by, for example, an earthquake, etc. In the anchor bolts 10 fixing the right side part in the figure in the column base fitting 42, the tensile loads P5 and P4 generate respectively as the reaction forces to prevent to lift up the right side part in the figure of the column base fitting 42 by the bending moment M.

Figure 12:
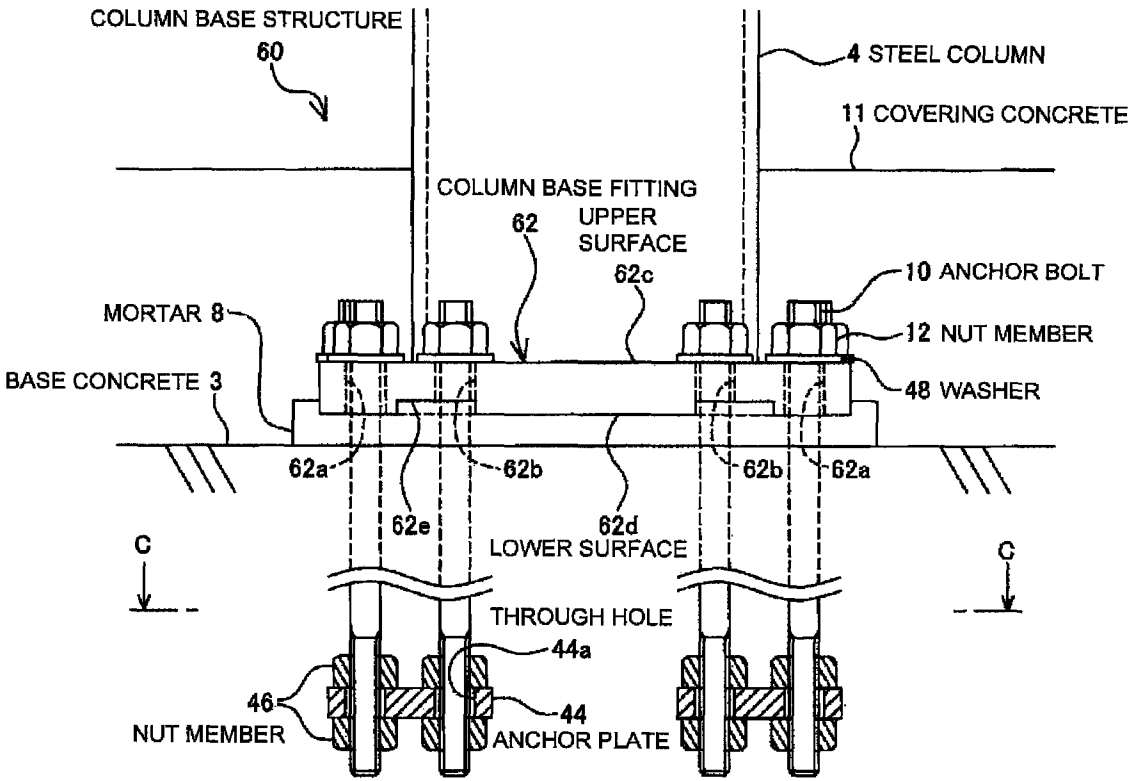
FIG. 12 is a partially enlarged cross-sectional side view illustrating the column base structure 60 according to the second exemplary embodiment of the present invention.

In the conventional column base structure 2, the tensile load P2 generates in the anchor bolt 10, which is inserted and fixed in the bolt insertion hole 6*b* and apart by the length L2 from the rotation center O of the steel column 4 in FIG. 12. On the other hand, in the column base structure 40 according to the present exemplary embodiment, the tensile load P4 generating in the anchor bolt 10 is significantly larger than the tensile load P2 of the conventional column base structure 2 since the length L4 is longer than the length L2. The anchor bolt 10 is inserted and fixed in the bolt insertion hole 42*b* and apart by the length L4 in the right direction in FIG. 10 from the rotation center O of the steel column 4 in the figure.

Therefore, it is possible that the flexural capacity of the column base structure 40 with respect to the bending moment M is significantly large as a whole, in comparison with the conventional column base structures 2 and 20.

Further, in the column base structure 40 according to the present exemplary embodiment, as illustrated in FIG. 2 and FIG. 5, the center position of the bolt insertion hole 42*a* is located at the position shifted close to the corner part 42*q* of the support base 42*f* from a cross point position of two lines (position apart by the length L1 from the imaginary lines X and Y in FIG. 5). One line passes the two center positions of the bolt insertion holes 42*b* formed at two places in the length direction of one side of the support base 42*c*. The other line passes the two center positions of the bolt insertion holes 42*b* formed at two places in the length direction of the adjacent side to the one side in the perpendicular direction.

As described above, the each center of the four bolt insertion holes 42*a* in the four corner portions of the column base fitting 42 is located at the position shifted close to the corner part 42*q* of the support base 42*f* from the cross point position. Taking such a constitution, the column base fitting 42 has higher rigidity than the case, in which the bolt insertion hole 42*a* is located at the cross point position. Thus, the thickness of the column base fitting 42 can be thin by considering the increased amount of rigidity.

Further, in the column base structure 40 according to the present exemplary embodiment, when main reinforcing steels 14 extending in the lateral direction in FIG. 11 are arranged, a predetermined interval is formed between the anchor bolts 10 and 10 inserted in the bolt insertion holes 42*b* and 42*b*, in each side extending in the vertical direction of the column base fitting 42 in FIG. 2.

Therefore, the three main reinforcing steels 14 extending in the lateral direction in FIG. 11 can be inserted together in the interval. Since there is no inserted anchor bolt 10 between the three main reinforcing steels 14 each, the arranging operation of the main reinforcing steels 14 can be easily performed without disturbance by the anchor bolt 10.

Further, when the main reinforcing steels 14 extending in the vertical direction in FIG. 11 (not illustrated) are arranged, the arranging operation of the main reinforcing steels 14 can be easily performed because of the same reason.

Further, in each side extending in the vertical direction of the column base fitting 42 in FIG. 11, the predetermined length interval between the anchor bolt 10 inserted in the bolt insertion hole 42*a* and the anchor bolt 10 inserted in the bolt insertion hole 42*b* are formed on upper and lower sides in FIG. 11 respectively. In these intervals, the main reinforcing steel 14 extending in the lateral direction in the figure can be inserted one by one.

Therefore, in each side extending in the vertical direction of the column base fitting 42 in FIG. 11, the interval enabling to be inserted by the main reinforcing steel 14 can be formed not only between the anchor bolts 10 and 10 inserted in the bolt insertion hole 42*b* and 42*b*, but also between the anchor bolt 10 inserted in the bolt insertion hole 42*a* and the anchor bolt 10 inserted in the bolt insertion hole 42*b*. Thus, the number of the main reinforcing steels 14 inserted between these anchor bolts 10 can be increased.

Further, when the main reinforcing steels 14 extending in the vertical direction in FIG. 11 (not illustrated) are arranged, the number of the main reinforcing steels 14 inserted between these anchor bolts 10 can be increased because of the same reason.

Therefore, as described above, accord to the column base fitting 42 in the present exemplary embodiment and the column base structure 40 using it, the flexural capacity of the entirety of the column base structure 40 can be increased and the increase of size, weight, and cost of the column base fitting 42 can be prevented.

FIGS. 12 to 19 are views explaining a column base fitting 62 according to a second exemplary embodiment and a column base structure 60 using it.

The same parts as the column base fitting 42 and the column base structure 40 according to the first exemplary embodiment are explained by adding the same codes. The overlapped explanations about the same constitutions as the column base fitting 42 and the column base structure 40 according to the first exemplary embodiment are omitted except a part as follows.

As illustrated in FIG. 12, a column base structure 60 according to the present exemplary embodiment includes a plate-shaped column base fitting 62. The column base fitting 62 is provided upward the concrete base 3 through the mortar 8. Further, on the upper surface 62*c* (surface) of the column base fitting 62, the lower end surface of the steel column 4 (column member) formed to be a rectangular tube and having a length in the vertical direction in the figure is jointed by welding.

Further, the upper end of the anchor bolt 10 penetrating the mortar 8 and protruding upward from in the base concrete 3 is inserted in a bolt insertion holes 62*a* and 62*b* formed in the column base fitting 62.

The male screw portion formed on the upper end of the anchor bolt 10 protruding upward on the column base fitting 62 penetrates the through hole (not illustrated) of washer 48, is screwed with the female screw portion of the nut member 12. Taking this constitution, the steel column 4 is stood and fixed on the base concrete 3 through the column base fitting 62 and the mortar 8.

A covering concrete 11 is formed on the base concrete 3. The covering concrete 11 has an upper surface at a position higher than the upper end position of anchor bolt 10 in the height direction. The covering concrete 11 buries each members, such as, the lower end of the steel column 4, the column base fitting 62, the mortar 8, the upper end of the anchor bolt 10, and the nut member 12, etc. inside thereof.

Figure 13:
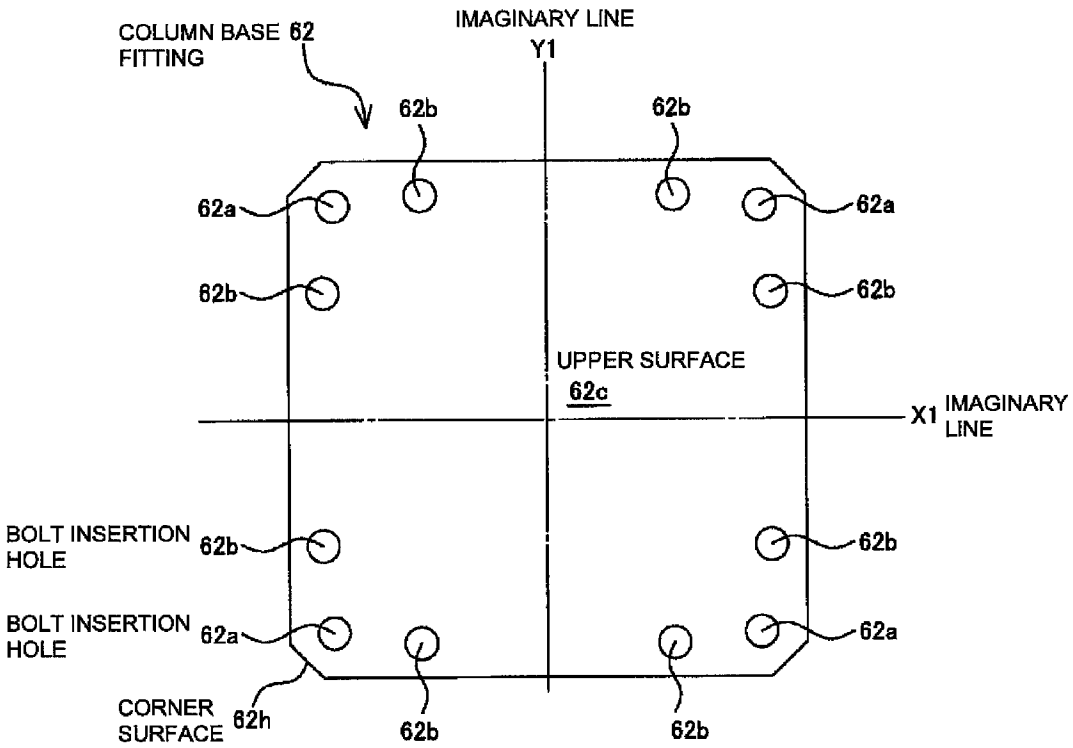
FIG. 13 is a top view of the column base fitting 62 in the column base structure 60 illustrated in FIG. 12.

As illustrated in FIG. 13, the column base fitting 62 is made of metal plate having a square shape, both surfaces of upper and lower, and thickness. In each four corner portions of the square shape, a corner surface 62*h* is formed.

In the column base fitting 62, a bolt insertion hole 62*a* (first bolt insertion hole) and a bolt insertion hole 62*b* (second bolt insertion hole) are formed by 3 holes at each four corner portions respectively in total 12. The diameter of each hole of the bolt insertion hole 62*a* and the bolt insertion hole 62*b* is formed approximately same, and one anchor bolt 10 loosely inserts in each hole.

One bolt insertion hole 62*a* is formed at close to each four corner portions of the square shape of the column base fitting 62.

Further, the center position of the bolt insertion hole 62*b* is located at a position which is closer to the center in each length of four sides of the square shape of the column base fitting 62 than the bolt insertion hole 62*a* at the corner portion, in the both ends in each side of four sides of the square shape of the column base fitting 62.

Figure 15:
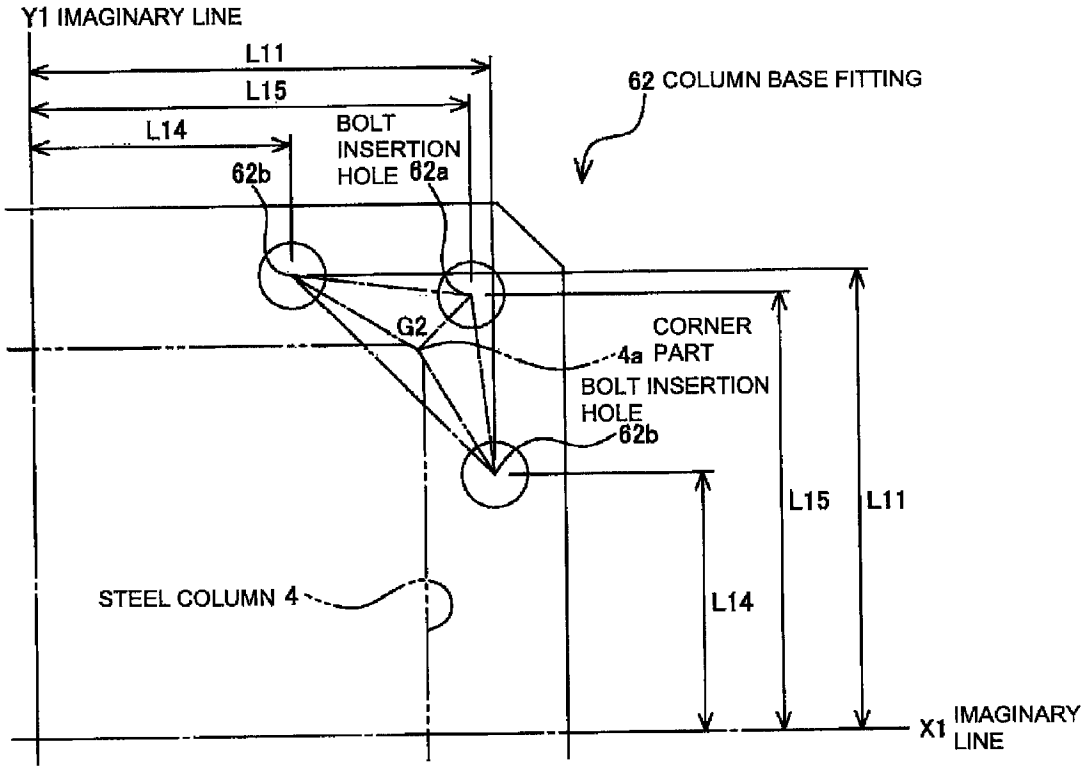
FIG. 15 is a view enlarging the upper right part of the column base fitting 62 illustrated in FIG. 13, that is, a partially enlarged top view for explaining each position of the bolt insertion hole 62*a* and 62*b*.

Namely, as illustrated in FIG. 15, the center position of the bolt insertion hole 62*a* is located at the position apart by the length L15, which is shorter than the length L11, from an imaginary line X1 (a horizontal center line in the figure) in the vertical direction in the figure. In addition, the center position of the bolt insertion hole 62*a* is located at the position apart by the length L15, which is shorter than the length L11, from an imaginary line Y1 (a vertical center line in the figure) in the lateral direction in the figure. The imaginary line X1 extends in the lateral direction and passes the center position in the vertical direction of the column base fitting 62. The imaginary line Y1 extends in the vertical direction and passes the center position in the lateral direction of the column base fitting 62. The each center position of the bolt insertion holes 62*a* is located at the four positions (at the four corner portions) of the column base fitting 62 respectively.

Further, for example, the center position of the bolt insertion hole 62*b* on the right side in FIG. 15 is located at the position apart by the length L11 from the imaginary line Y1 in the right direction in the figure, and apart by the length L14 from the imaginary line X1 in the upward direction in the figure, in the side extending in the vertical direction in the figure of the column base fitting 62.

Furthermore, the each center of the bolt insertion holes 62*b* is located at the position apart by an approximately same length from the imaginary line X1 and the imaginary line Y1, in the each four sides of the column base fitting 62.

As illustrated in FIG. 15, in the bolt insertion hole 62*a* formed at the corner portion of the column base fitting 62 and two bolt insertion holes 62*b* located in both sides of the bolt insertion hole 62*a*, a triangle is formed by lines connecting each center position of these holes in a horizontal plane. The each center position of the bolt insertion holes 62*a* and 62*b* are located at a position in which the gravity center G2 of the triangle comes to a position corresponding to the corner part 4*a* of the steel column 4.

Similarly, in three anchor bolts 10 inserted in the bolt insertion hole 62*a* and two bolt insertion holes 62*b*, a triangle is formed by lines connecting each center position of these anchor bolts 10 in a horizontal plane. The each center position of the anchor bolts 10 are located at a position in which the gravity center G3 (refer to FIG. 16) of the triangle comes to a position corresponding to the corner part 4*a* of the steel column 4.

Therefore, the gravity center G3 of the three anchor bolts 10 inserted in the bolt insertion hole 62*a* and two bolt insertion holes 62*b* is located at the same or similar position of the gravity center G2 of the bolt insertion holes 62*a* and two bolt insertion holes 62*b*.

In the column base fitting 62, the force generated in the steel column 4 by an earthquake, etc., transmits to the base concrete 3 through the anchor bolts 10. The thickness t1 of the column base fitting 62 illustrated in FIG. 16 is designed to withstand the predetermined bending stress.

Figure 16:
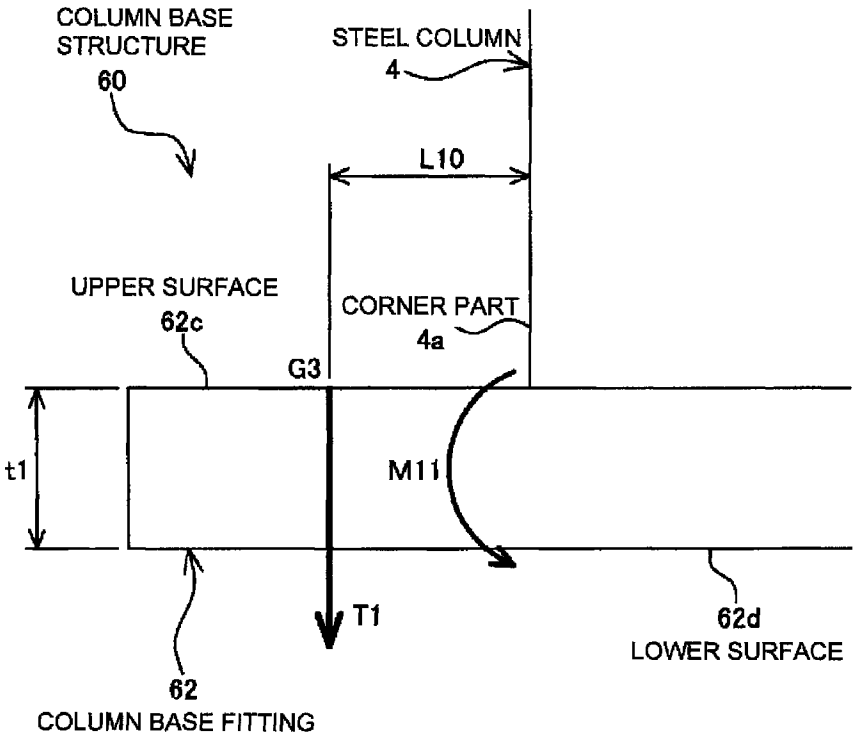
FIG. 16 is a conceptual side view for explaining a state in which the tensile load T1 is applied to the column base fitting 62 in the column base structure 60 illustrated in FIG. 12.

When the bending moment M 10 (refer to FIG. 18) is applied to the column base structure 60 due to earthquake, etc., the resultant force T1 of the tensile load generates in the three anchor bolts 10 inserted in the bolt insertion hole 62*a* and two bolt insertion holes 62*b*, as illustrated in FIG. 16. As the result of this, the tensile load T1 acts to the gravity center G3 of the triangle of the three anchor bolts 10 in the column base structure 62.

At this time, the bending moment M11 generates at the lower end position in height of the corner part 4*a* of the steel column 4 of the column base fitting 62. The bending moment M11 is proportional the tensile load T1 and the distance L10 from the gravity center G3 of the three anchor bolts 10 to the lower end position in height of the corner part 4*a* of the steel column 4.

The thickness t1 of the column base fitting 62 is designed considering the bending moment M11 applying to the column base fitting 62.

In the column base structure 60 according to the present exemplary embodiment, the gravity center G3 of the three anchor bolts 10 inserted in the bolt insertion hole 62*a* and two bolt insertion holes 62*b* of the column base fitting 62 is located at a position corresponding to the corner part 4*a* of the steel column 4. Accordingly, the distance L10 from the gravity center G3 of the anchor bolt 10 to the lower end position of the height of the corner part 4*a* of the steel column 4 can be remarkably shorted so as to approach about zero.

Remarkably shorting the distance L10 from the gravity center G3 of the anchor bolt 10 to the lower end position of the height of the corner part 4*a* of the steel column 4, the bending moment M11 can be remarkably small, so that the thickness t1 of the column base fitting 62 can be thin.

Therefore, in the column base structure 60 according to the present exemplary embodiment, since the thickness t1 of the column base fitting 62 can be thin, the increase of size, weight, and cost of the column base fitting 62 can be prevented.

Figure 14:
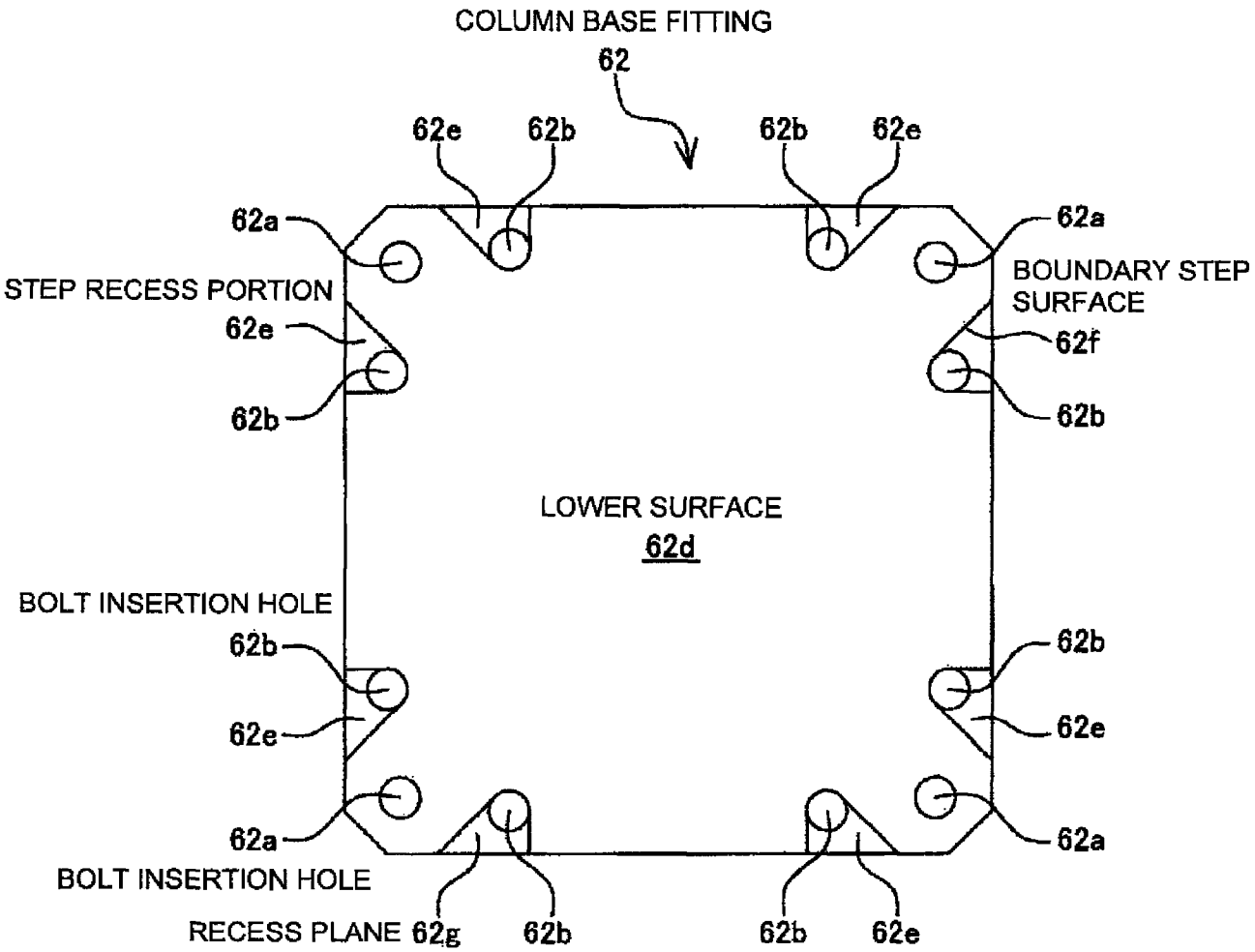
FIG. 14 is a bottom view of the column base fitting 62 illustrated in FIG. 13.

In the column base fitting 62, as illustrated in FIG. 14, in each four corner portions of the bottom surface 62*d* (back surface) of the column base fitting 62, two step recess portions 62*e* having recess planes 62*g* recessing toward the back side of the paper in the figure from a lower surfaces 62*d* is formed. The height of an area of the step recess portion 62*e* of the column base fitting 62 is formed lower than the height from the lower surface 62*d* to an upper surface 62*c* of the column base fitting 62.

A boundary step surface 62*f* is formed at a step portion of the recess plane 62*g* of the step recess portion 62*e* and the lower surface 62*d*. In the boundary step surface 62*f*, the center part in the length contacts an inner periphery surface of the bolt insertion hole 62*b* and the both ends in the length of the boundary step surface 62*f* is formed extending until to open at the side surface of the column base fitting 62.

Therefore, the step recess portion 62*e* is formed to have such an approximately triangle shape as to extend outward from the bolt insertion hole 62*b* and open at the side surface of the column base fitting 62.

In the column base structure 60 according to the present exemplary embodiment, the step recess portion 62*e* and the boundary step surface 62*f* are formed in the column base fitting 62. Thus, even when the horizontal force F1 (refer to FIG. 17) is applied to the column base fitting 62, it can be prevented that the column base fitting 62 is shifted in the horizontal direction with respect to the base concrete 3, by the similar reason in the above column base structure 40 according to the first exemplary embodiment. The horizontal force F1 is generated by the shearing force acting to the horizontal cross-sectional surface of the steel column 4 at the same time of generating the bending moment M10, by an earthquake, etc.

Further, the anchor bolt 10 receives the horizontal force F1 applied to the column base fitting 62 and exhibits the resistance force. Thus, it can be prevented that the mortar 8 is broken when the horizontal force F1 is directly received by only the mortar 8.

Figure 17:
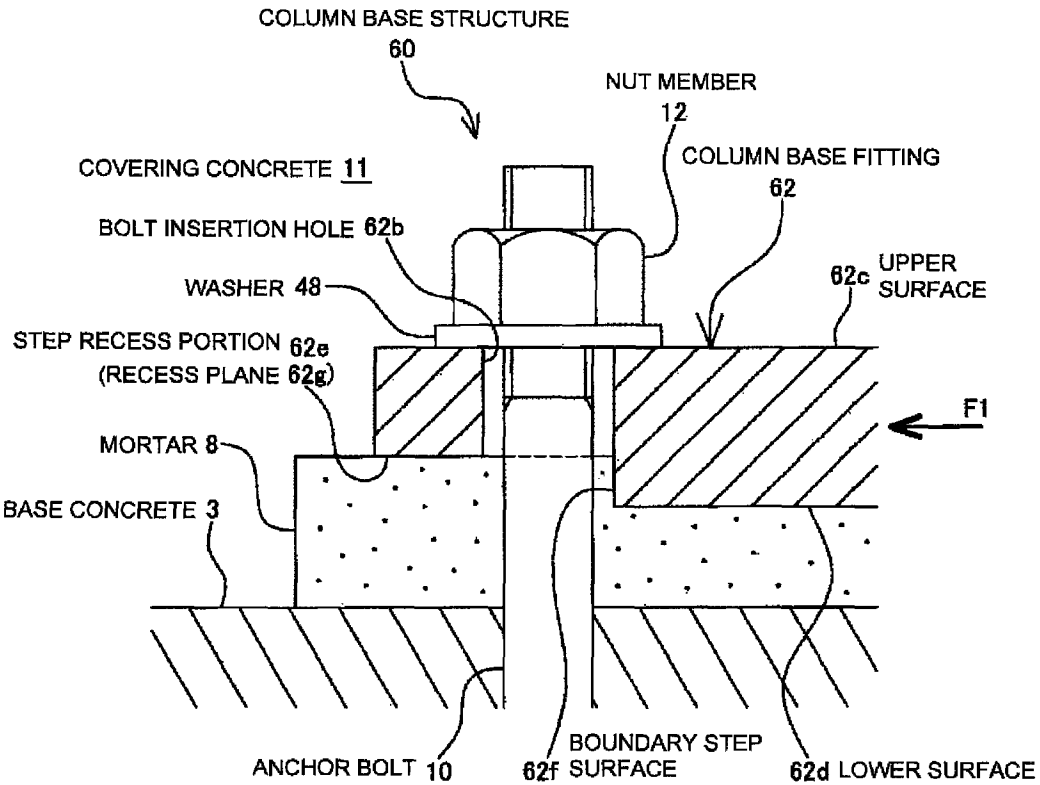
FIG. 17 is a partially enlarged cross-sectional view illustrating the joint part of the anchor bolt 10 and the column base fitting 62 in the column base structure 60 illustrated in FIG. 12.

Further, as illustrated in FIGS. 14 and 17, the step recess portion 62*e* of the column base fitting 62 is formed to have a shape, which opens toward the outside from the bolt insertion hole 62*b*. Thus, the mortar 8 can be easily filled between the column base fitting 62 and the base concrete 3.

Figure 18:
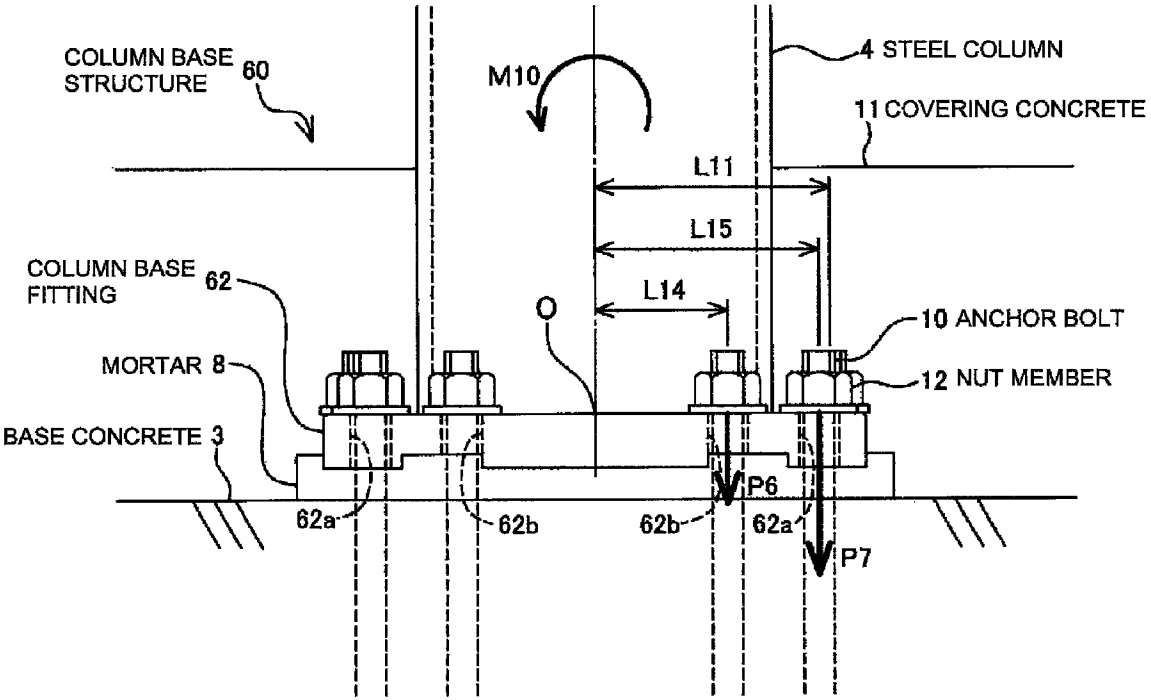
FIG. 18 is a conceptual side view for explaining a state in which the bending moment M10 is applied in the column base structure 60 illustrated in FIG. 12.

In the column base structure 60 according to the present exemplary embodiment, as illustrated in FIG. 18, when the load generating large bending moment M10 is applied to the steel column 4 in the column base structure 60, the tensile loads P7 and P6 generate in the anchor bolts 10 respectively as the reaction force to prevent to lift up the right side part in the figure of the column base fitting 62. The load generating the large bending moment M is applied in the anti-clockwise direction around the rotation center O of the joint portion with the column base fitting 62 by, for example, an earthquake, etc. The anchor bolts 10 fixes the right side part in the figure in the column base fitting 62.

Figure 28:
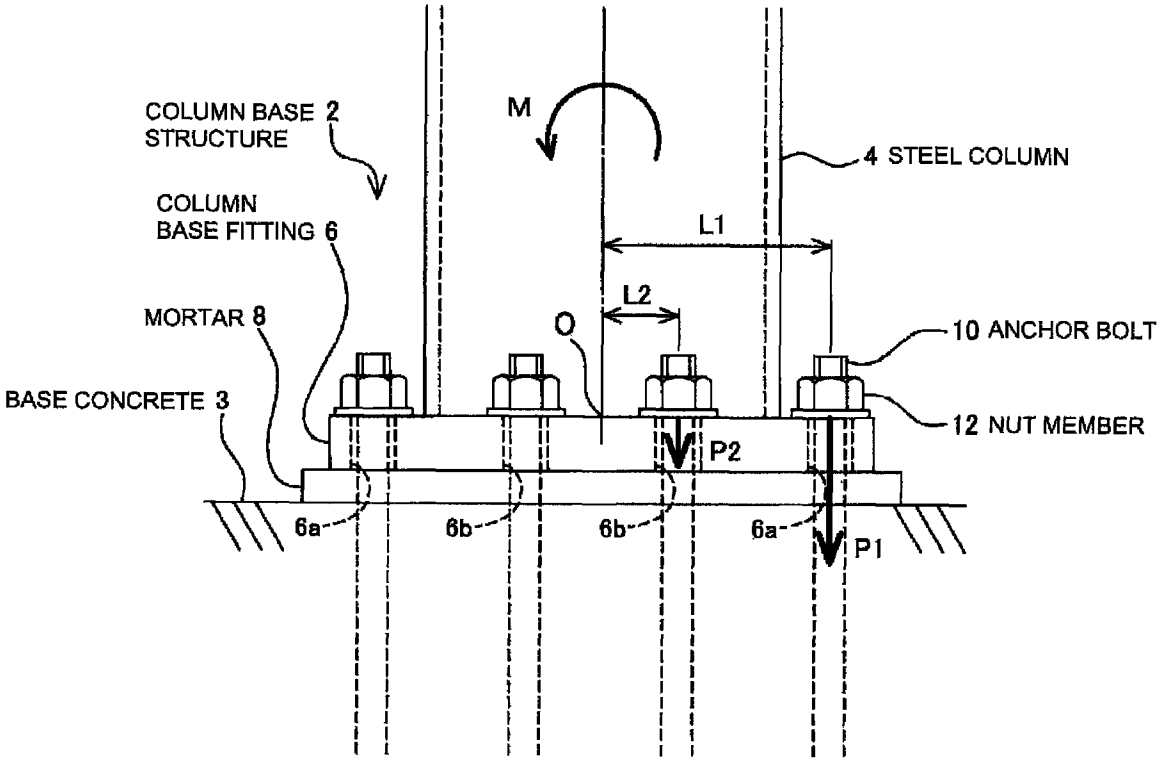
FIG. 28 is a conceptual side view illustrating a first conventional column base fitting 2.
Figure 29:
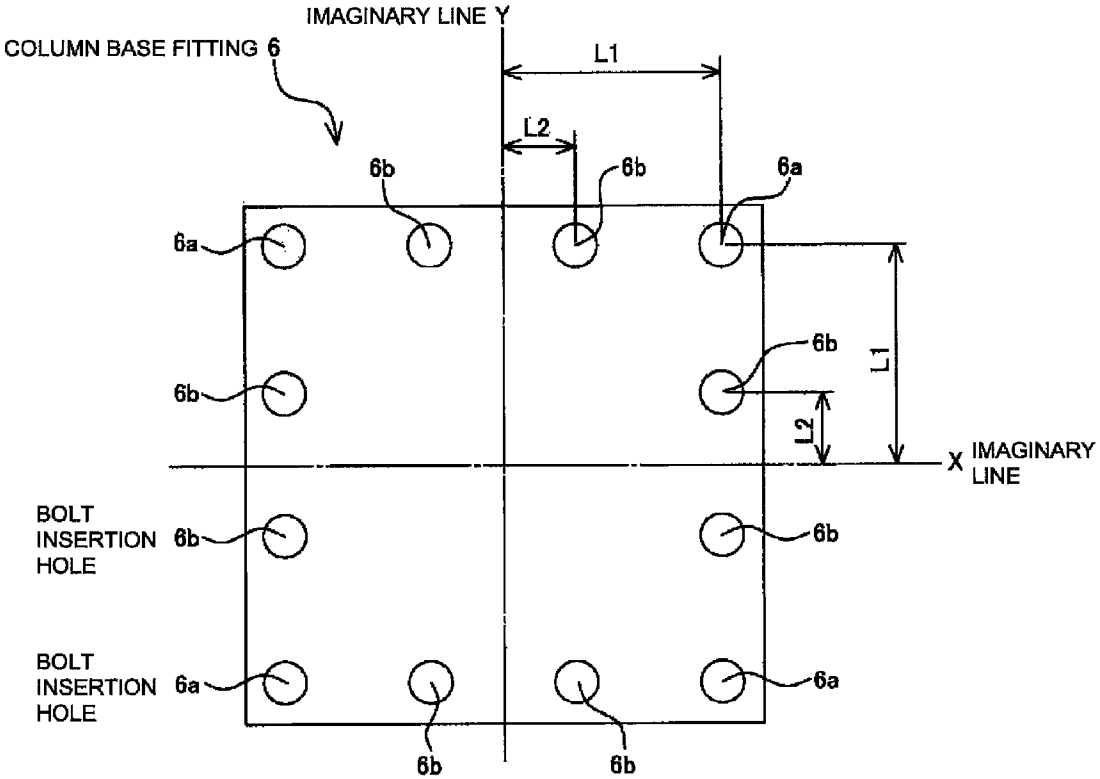
FIG. 29 is a top view of the column base fitting 6 in the column base structure 2 illustrated in FIG. 28.
Figure 30:
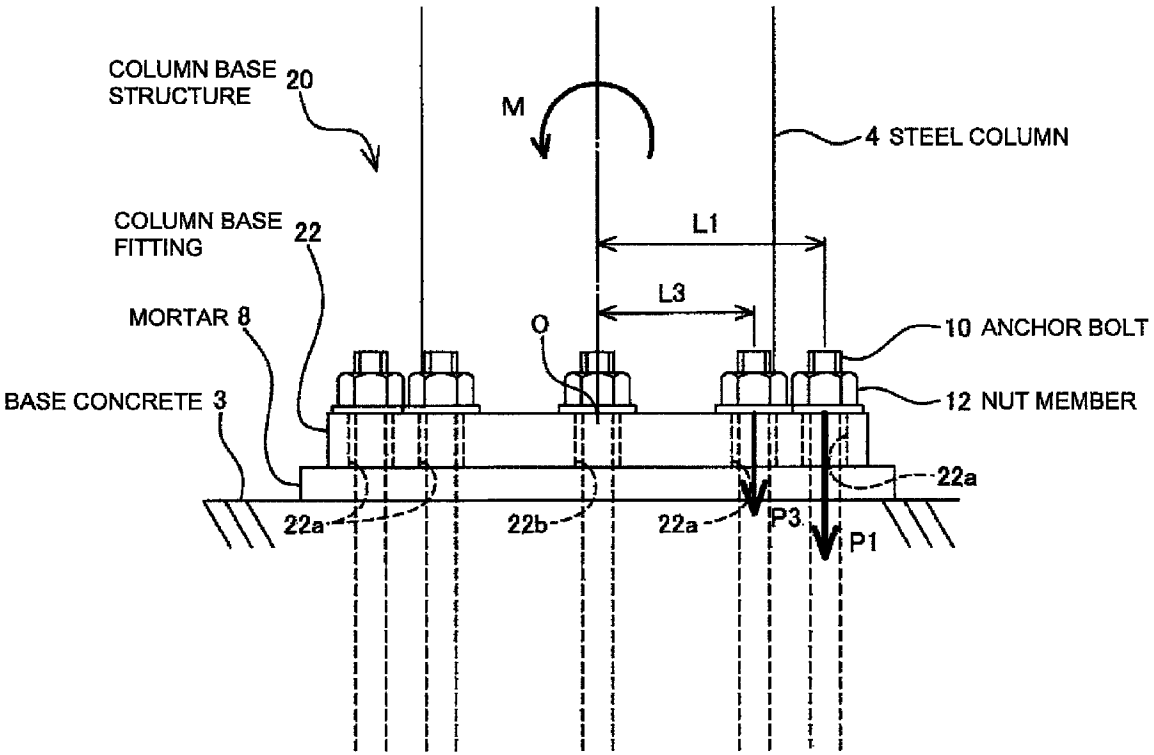
FIG. 30 is a conceptual side view illustrating a second conventional column base fitting 20.
Figure 31:
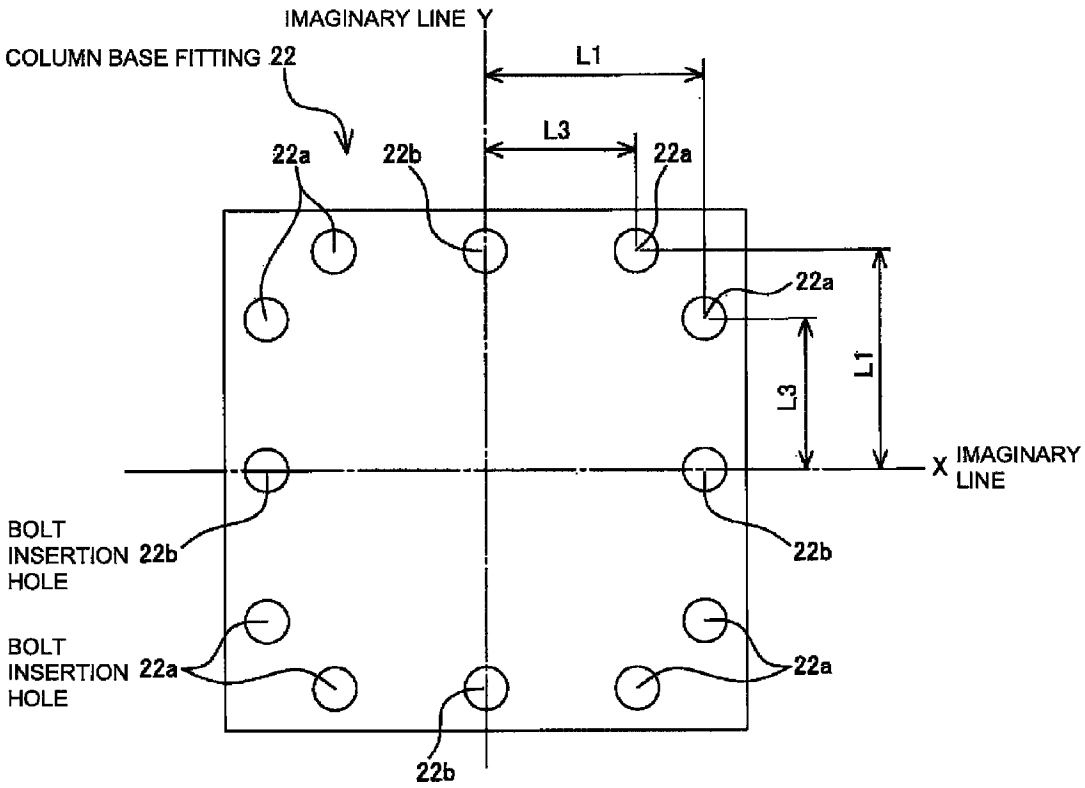
FIG. 31 is a top view of the column base fitting 22 in the column base structure illustrated in FIG. 30.

In the conventional column base structure 2, the tensile load P2 generates in the anchor bolt 10 inserted and fixed in the bolt insertion hole 6*b*, which is located at the position apart by the length L2 from the rotation center O of the steel column 4 in FIG. 28. On the other hand, in the column base structure 60, the tensile load P6 generates in the anchor bolt 10 inserted and fixed in the bolt insertion hole 62*b*, which is located at the position apart by the length L14 in the right direction in FIG. 18 from the rotation center O of the steel column 4. The tensile load P6 in the column base structure 60 is remarkably larger than the tensile load P2 in the conventional column base structure 2 since the length L14 is longer than the length L2.

Therefore, the flexural capacity of the column base structure 60 with respect to the bending moment M can be remarkably large as a whole in comparison with the case of the conventional column base structures 2 and 20.

Further, in the column base structure 60 according to the present exemplary embodiment, as illustrated in FIGS. 13 and 15, the center position of the bolt insertion hole 62*a* of the column base structure 62 is located at the position shifted close to the corner part 4*a* of the steel column 4 (close to the center portion of the column base fitting 62) from the cross point of two lines (the position apart by the length L11 from the imaginary lines X1 and Y1 in FIG. 15). One line passes two center positions of the bolt insertion holes 62*b* formed at two positions in the length direction in one side of the column base fitting 62. The other line passes two center positions of the bolt insertion holes 62*b* formed at two positions in the length direction in the other side portion adjacent in the perpendicular direction to the one side portion.

Locating each center of the four bolt insertion holes 62*a* at the position shifted close to the corner part 4*a* of the steel column 4, the rigidity of the column base fitting 62 becomes higher than the case in which the bolt insertion hole 62*a* is located at the cross point. The four bolt insertion holes 62*a* are located at the four corner portions of the column base fitting 62. Thus, considering the increase of the rigidity, the thickness of the column base fitting 62 can be thinned.

Figure 19:
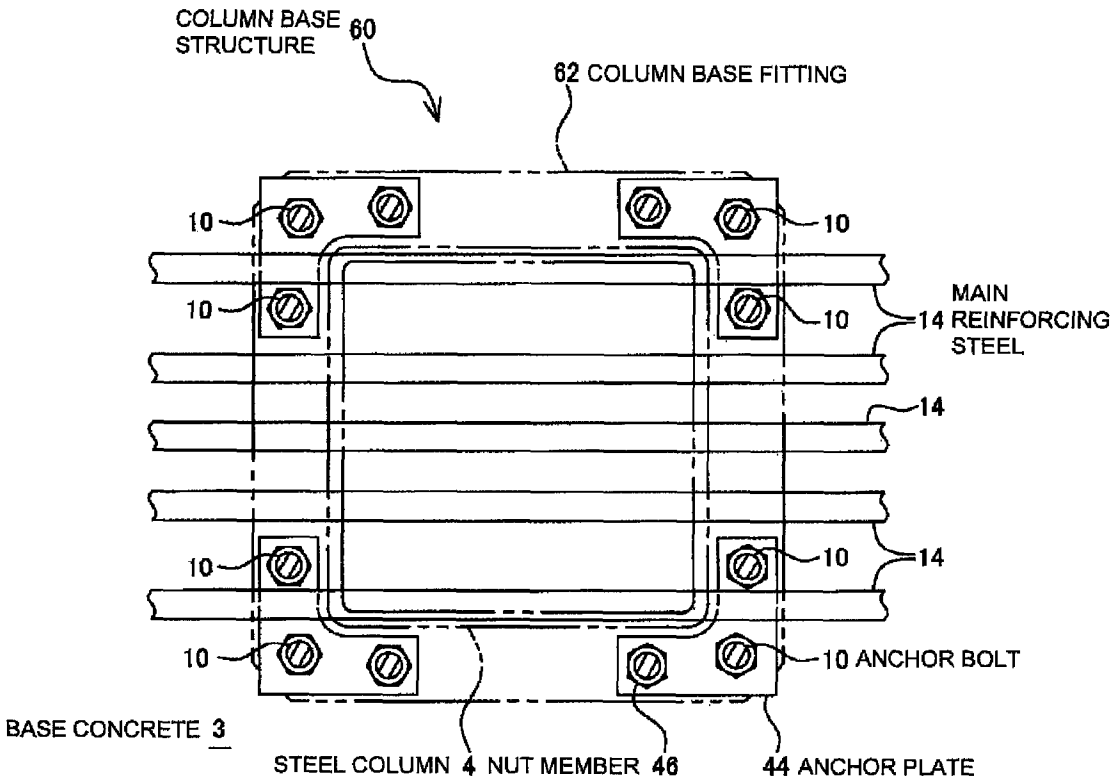
FIG. 19 is a cross-sectional view taken along a line C-C in the column base structure 60 illustrated in FIG. 12.

Further, in the column base structure 60 according to the present exemplary embodiment, when main reinforcing steels 14 extending in the lateral direction in FIG. 19 are arranged, a predetermined interval is formed between the anchor bolts 10 and 10 inserted in the bolt insertion holes 62*b* and 62*b*, in each side extending in the vertical direction of the column base fitting 42 in FIG. 13.

Therefore, by the same reason as the column base structure 40 according to the first exemplary embodiment, the operation of arranging the main reinforcing steel 14 can be easily performed.

Further, by the same reason as the column base structure 40 according to the first exemplary embodiment, many main reinforcing steels can be arranged between the anchor bolts 10.

Therefore, as described above, in the column base fitting 62 according to the present exemplary embodiment and the column base structure 60 using it, the flexural capacity of the column base structure 60 as a whole can be increased and the increase of size, weight, and cost of the column base fitting 62 can be prevented.

FIGS. 20 to 27 are views explaining a column base fitting 82 according to the third exemplary embodiment and a column base structure 80 using it.

The same parts as the column base fitting 42 and the column base structure 40 according to the first exemplary embodiment are explained by adding the same codes. The overlapped explanations about the same constitutions as the column base fitting 42 and the column base structure 40 according to the first exemplary embodiment are omitted except a part.

Figure 20:
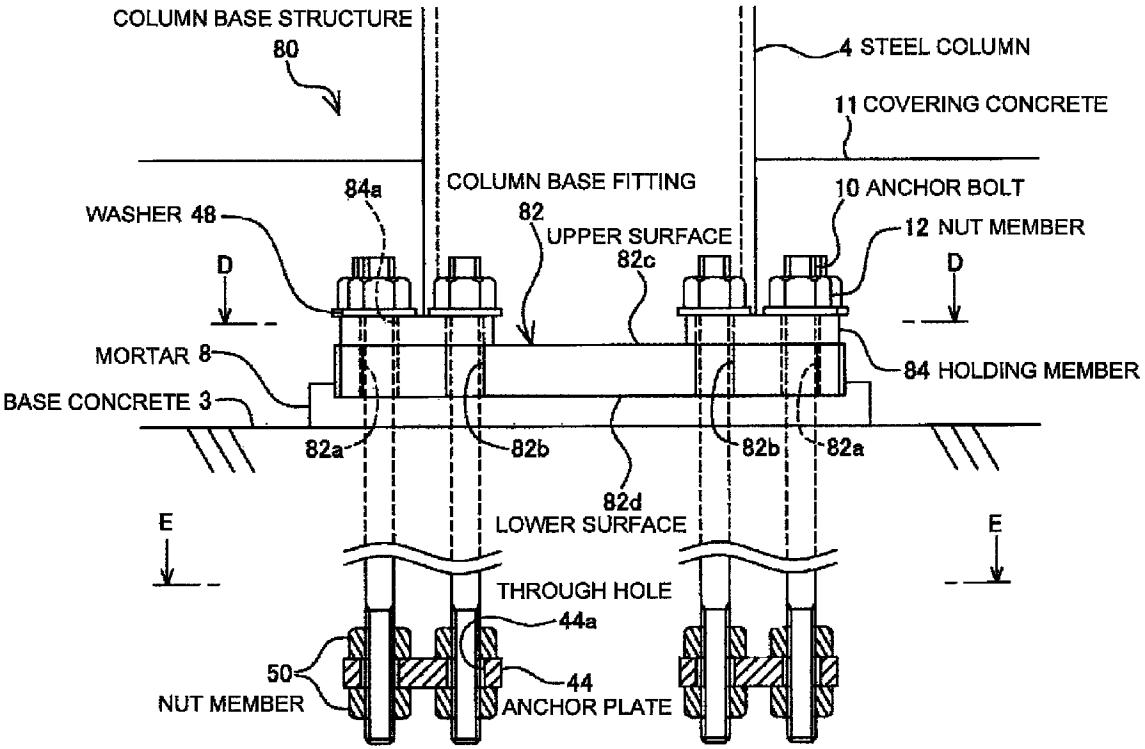
FIG. 20 is partially cross-sectional side view illustrating a column base structure 80 in the third exemplary embodiment of the present invention.

As illustrated in FIG. 20, a column base structure 80 according to the present exemplary embodiment includes a plate-shaped column base fitting 82 and a holding member 84 placed on an upper surface 82*c* of the column base fitting 82. The column base fitting 82 is provided upward the base concrete 3 through the mortar 8. Further, on the upper surface 82*c* (surface) of the column base fitting 82, the lower end surface of the steel column 4 (column member) formed to be a rectangular tube and having a length in the vertical direction in the figure is jointed by welding.

The upper end of the anchor bolt 10 penetrating the mortar 8 and protruding upward the mortar 8 from the base concrete 3 is inserted in an opening recess portions 82*a* and 82*b* formed in the column base fitting 82 and a bolt insertion hole 84*a* formed in the holding member 84.

A male screw part formed on the upper end of the anchor bolt 10 penetrates a through hole not illustrated of the washer 48 and is screwed with a female screw part of the nut member 12. Thus, the steel column 4 is stood and fixed on the base concrete 3 through the column base fitting 82 and the holding member 82.

Further, the covering concrete 11 is formed on the base concrete 3. The height of the upper surface of the covering concrete 11 is higher than the height of the upper end of the anchor bolt 10. The covering concrete 11 buries each member, such as, the lower end of the steel column 4, the column base fitting 82, the holding member 84, the mortar 8, the upper end of the anchor bolt 10, and the nut member 12, etc.

Figure 21:
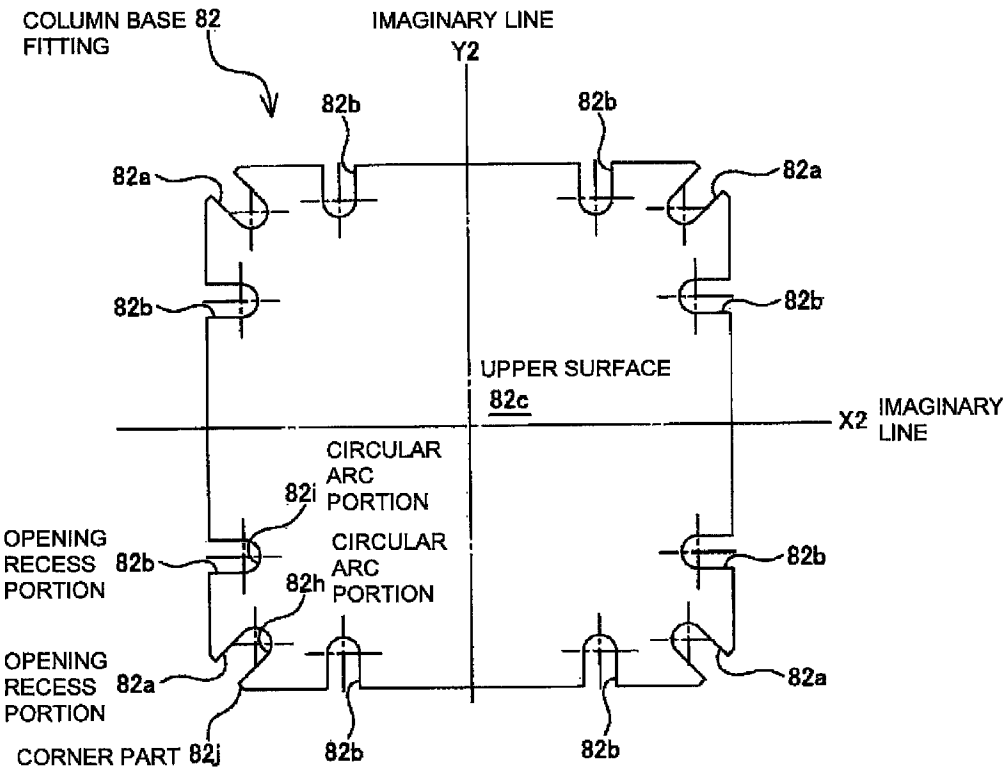
FIG. 21 is a top view of a column base fitting 82 in the column base structure 80 illustrated in FIG. 20.

As illustrated in FIG. 21, the column base fitting 82 is made of a metal plate shape having a square shape, both surfaces of upper and lower, and thickness. In each four corner portions of the square shape, a remained part of such a corner surface 82*j* as to be made by chamfering.

In each four corner portions of the column base fitting 82, one opening recess portion 82*a* (first notch portion) notched to have an approximately U shape toward the center of the square shape is formed. Further, in each four corner portions of the column base fitting 82, two opening recess portions 82*b* (second notch portion) notched to have an approximately U shape are formed in the parallel direction to the each imaginary lines X2 and Y2 and entering toward inside.

In these opening recess portions 82*a* and 82*b*, each opening width is approximately the same and formed slightly larger than the diameter of the anchor bolt 10. One anchor bolt 10 is loosely inserted in the each opening recess portion 82*a* and 82*b*.

The opening recess portion 82*a* is formed in each four corner portions of the square shape of the column base fitting 82 one by one. The opening recess portion 82*a* is formed to be notched in such a manner as to enter toward the center of the length of the diagonal line of the square shape from the corner surface 82*j* of four corner portions of the square shape of the column base fitting 82. The innermost part of the opening recess portion 82*a* is formed to be an approximately U shape having a circular arc portion 82*h* having a semi-circular shape.

Further, the opening recess portion 82*b* is formed to be notched in such a manner as to enter in the approximately perpendicular direction to the side from each side of four sides of the square shape of the column base fitting 82. The innermost part of the opening recess portion 82*b* is formed to be an approximately U shape having a circular arc portion 82*i* having a semi-circular shape. In the opening recess portion 82*b*, the center position of the circular arc portion 82*i* is located at the position which is shifted close to the center of the length of the side than the center position of the circular arc portion 82*h* of the opening recess portion 82*a* at the corner portion, in each both ends of the four sides of the square shape of the column base fitting 82.

Figure 23:
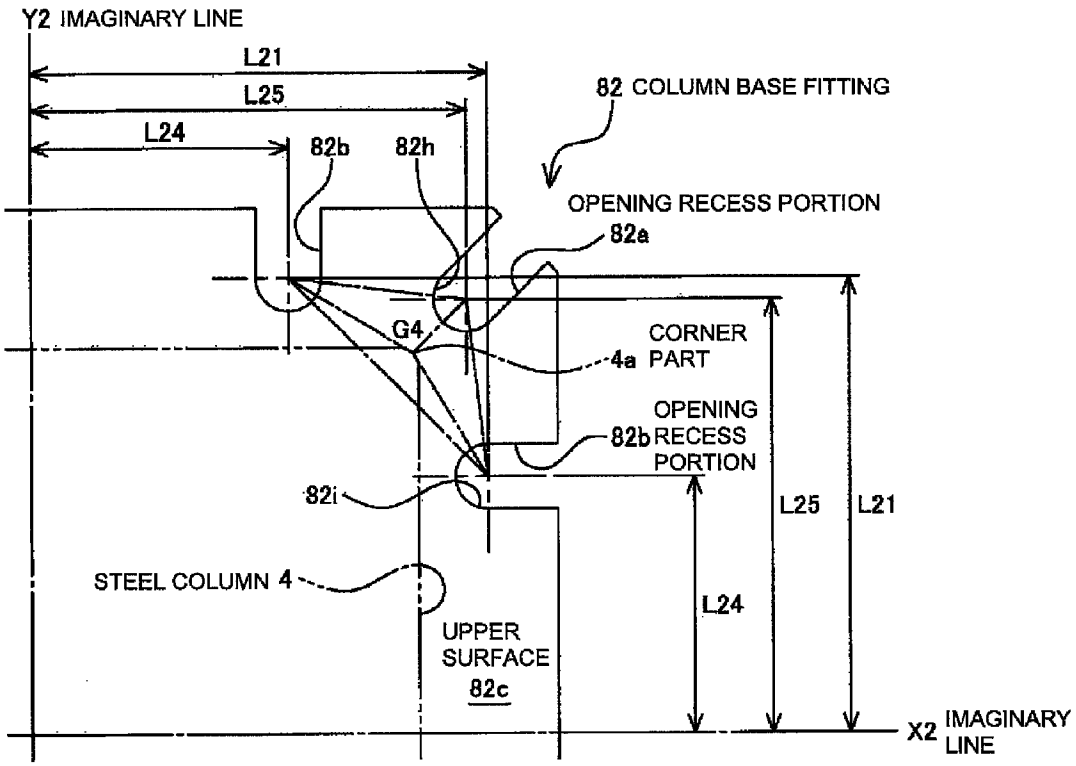
FIG. 23 is a view enlarging the upper right part of the column base fitting 82 illustrated in FIG. 21, that is, a partially enlarged top view for explaining each position of opening recess portions 82*a* and 82*b*.

Namely, as illustrated in FIG. 23, in the each opening recess portion 82*a* in the four corner portions of the column base fitting 82, the center position of the circular arc portion 82*h* is located at the position apart by the length L25, which is shorter than the length L21, from an imaginary line X2 in the upper direction in the figure. The imaginary line X2 (the center line in the horizontal direction in the figure) extends in the lateral direction in the figure and passes the center position in the vertical direction in the figure of the column base fitting 82. Further, the center position of the circular arc portion 82*h* is located at the position apart by the length L25, which is shorter than the length L21, from an imaginary line Y2 in the right direction. The imaginary line Y2 (the center line in the vertical direction in the figure) extends in the vertical direction in the figure and passes the center position in the lateral direction in the figure of the column base fitting 82.

Further, for example, in the opening recess portion 82*b* in the right side in FIG. 23, the center position of the circular arc portion 82*i* is located at a position apart by the length L21 from the imaginary line Y2 in the right direction in the figure, and a position apart by the length L24 from the imaginary line X2 in the upper direction in the figure, in the side extending in the vertical direction in the figure of the column base fitting 82.

Further, in the each opening recess portion 82*b*, the center position of the circular arc portion 82*i* is located at a position approximately the same length from the imaginary line X2 and the imaginary line Y2.

As illustrated in FIG. 23, in the opening recess portion 82*a* formed in four corner portions of the column base fitting 82 and two opening recess portions 82*b* located both sides of the opening recess portion 82*a*, a triangle is formed by lines connecting the each center position of the circular arc portions 82*h* and 82*i* on the horizontal plane. The each center position of the circular arc portions 82*h* and 82*i* is located at a position in which the gravity center G4 of the triangle comes to a position corresponding to the corner part 4*a* of the column 4.

In the three anchor bolts 10 inserted in the circular arc portion 82*h* of the opening recess portion 82*a* and the two circular arc portions 82*i* of the opening recess portion 82*b*, similarly, a triangle is formed by lines connecting each center position on the horizontal plane. The each center position of the circular recess portions 82*h* and 82*i* is located at a position in which the gravity center G5 (refer to FIG. 24) of the triangle comes to a position corresponding to the corner part 4*a* of the steel column 4.

Therefore, the gravity center G5 of three anchor bolts 10 inserted in the circular arc portion 82*h* of the opening recess portion 82*a* and the two circular arc portions 82*i* of the opening recess portion 82*b* is located at the same or similar position as the gravity center G4 of the center positions of the circular arc portion 82*h* of the opening recess portion 82*a* and the two circular arc portions 82*i* of the opening recess portion 82*b*.

In the column base fitting 82 of the column base structure 80 illustrated in FIG. 20, the force generated in the steel column 4 by an earthquake, etc., is transmitted to the base concrete 3 through the anchor bolt 10. The thickness t2 of the column base fitting 82 illustrated in FIG. 24 is designed to withstand a predetermined bending stress.

Figure 24:
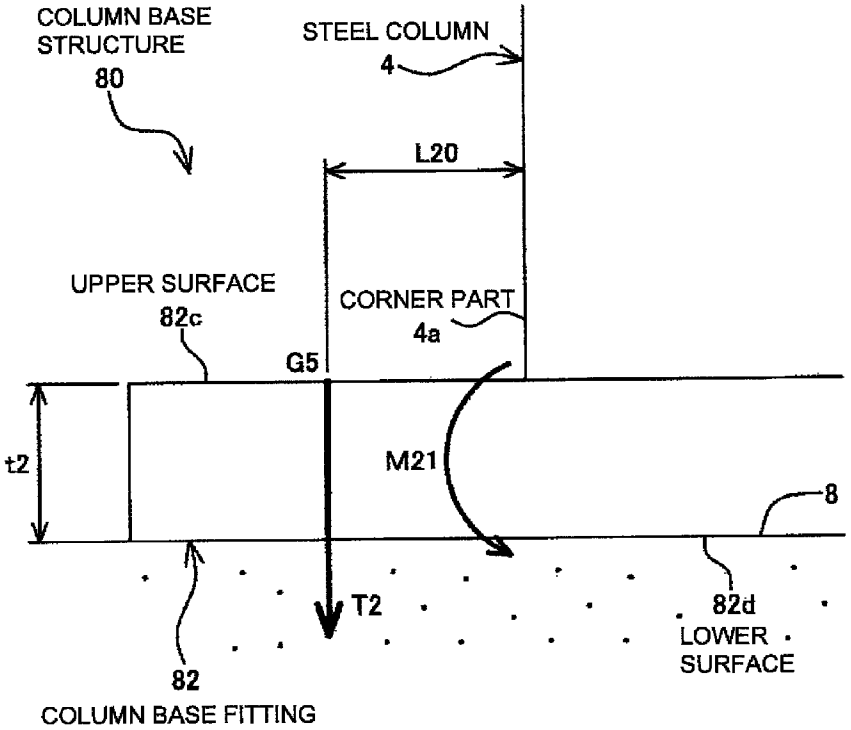
FIG. 24 is a conceptual side view for explaining a state in which the tensile load T2 is applied to the column base fitting 82 in the column base structure 80 illustrated in FIG. 20.

As illustrated in FIG. 24, when the bending moment M20 (refer to FIG. 26) is applied to the column base structure 80 by an earthquake, etc., the resultant force T2 of the tensile load generates in three anchor bolts 10 inserted in the circular arc portion 82*h* of the opening recess portion 82*a* and two opening recess portions 82*i* of the opening recess portion 82*b*. As the result of this, the tensile load T2 acts to the gravity center G5 of the triangle of the three anchor bolts 10 in the column base fitting 82.

At this time, the bending moment M21 generates at the lower end position in height of the corner part 4*a* of the steel column 4, in the column base fitting 82. The bending moment M21 is proportional the tensile load T2 and the distance L20 from the gravity center G5 of the triangle of the three anchor bolts 10 to the lower end position in height of the corner part 4*a* of the steel column 4.

The thickness t2 of the column base fitting 82 is designed considering the bending moment M21 applying to the column base fitting 82.

In the column base structure 80 according to the present exemplary embodiment, the gravity center G5 on a horizontal plane of the three anchor bolts 10 is located at the position corresponding to the corner part 4*a* of the steel column 4. The three anchor bolts 10 are inserted the circular arc portion 82*h* of the opening recess portion 82*a* and two circular arc portion 82*i* of the opening recess portion 82*b*. Accordingly, the length L20 from the gravity center G5 of the anchor bolt 10 to the lower end position of the height of the corner part 4*a* of the steel column 4 can be remarkably shorted so as to approach to remarkably zero.

Remarkably shorting the distance L20 from the gravity center G5 of the anchor bolts 10 to the lower end position in height of the corner part 4*a* of the steel column 4, the bending moment M21 can be remarkably small, so that the thickness t2 of the column base fitting 82 can be thin.

Therefore, in the column base structure 80 according to the present exemplary embodiment, since the thickness t2 of the column base fitting 82 can be thin, the increase of size, weight, and cost of the column base fitting 82 can be prevented.

Figure 22:
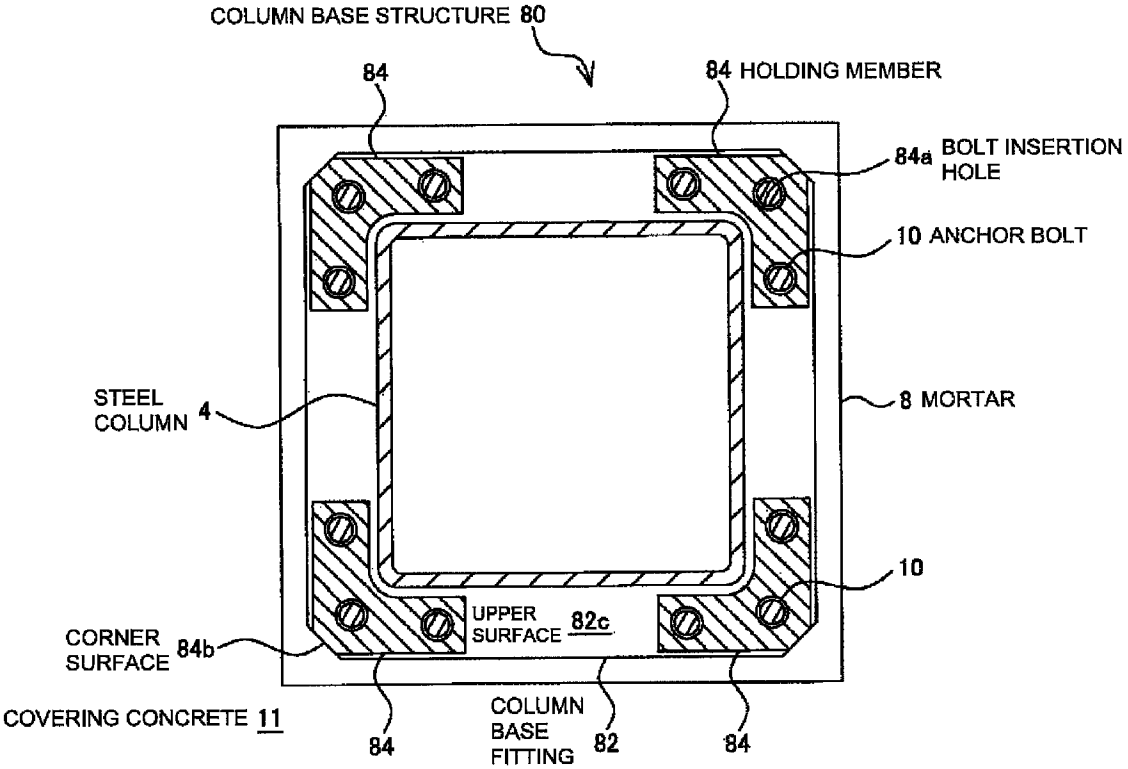
FIG. 22 is a cross-sectional view taken along a line D-D in the column base structure 80 illustrated in FIG. 20.

In the present exemplary embodiment, an outer shape of a holding member 84 illustrated in FIG. 20 is formed to be an approximately L shaped plate as illustrated in FIG. 22. A corner surface 84*b* is formed at a corner part between the two long side portions outside the L shape.

In the holding member 84, as illustrated in FIG. 20, the anchor bolt 10 is loosely inserted in the bolt insertion hole 84*a* penetrating in the thickness direction of the holding member 84. The nut member 12 is screwed with the anchor bolt 10 on the upper surface of the holding member 84, so that the holding member 84 and the column base fitting 82 are fixed upward the base concrete 3.

In the column base structure 80 according to the present exemplary embodiment, the opening recess portions 82*a* and 82*b* of the column base fitting 82 are formed to be not a circular shape but an approximately U shape, different from the column base structure 40 according to the first exemplary embodiment and the column base structure 60 according to the second exemplary embodiment. Thus, 12 anchor bolts 10 can be easily inserted in the opening recess portions 82*a* and 82*b* of the column base fitting 82 respectively. The upper ends of the 12 anchor bolts 10 can be put in the center positions of the circular arc portions 82*h* and 82*i* of the opening recess portions 82*a* and 82*b* from the lower side to the upper side and inserted in each opening recess portions 82*a* and 82*b*.

Then, the holding member 84 is attached on the upper ends of the three anchor bolts 10 through the nut member 12, and thereby the column base fitting 82 can be fixed upward on the base concrete 3. Thus, the installation can be easily performed.

Further, in the column base structure 80 according to the present exemplary embodiment, the opening recess portions 82*a* and 82*b* are formed to be notched in such a manner as to enter having the approximately U shape. Thus, even when a horizontal force F2 (refer to FIG. 25) is applied to the column base fitting 82, it can be prevented that the column base fitting 82 shifts in the horizontal direction. The horizontal force F2 is generated by a shearing force acting on the horizontal cross-section of the steel column 4 at the same time of the bending moment M by an earthquake, etc.

Figure 25:
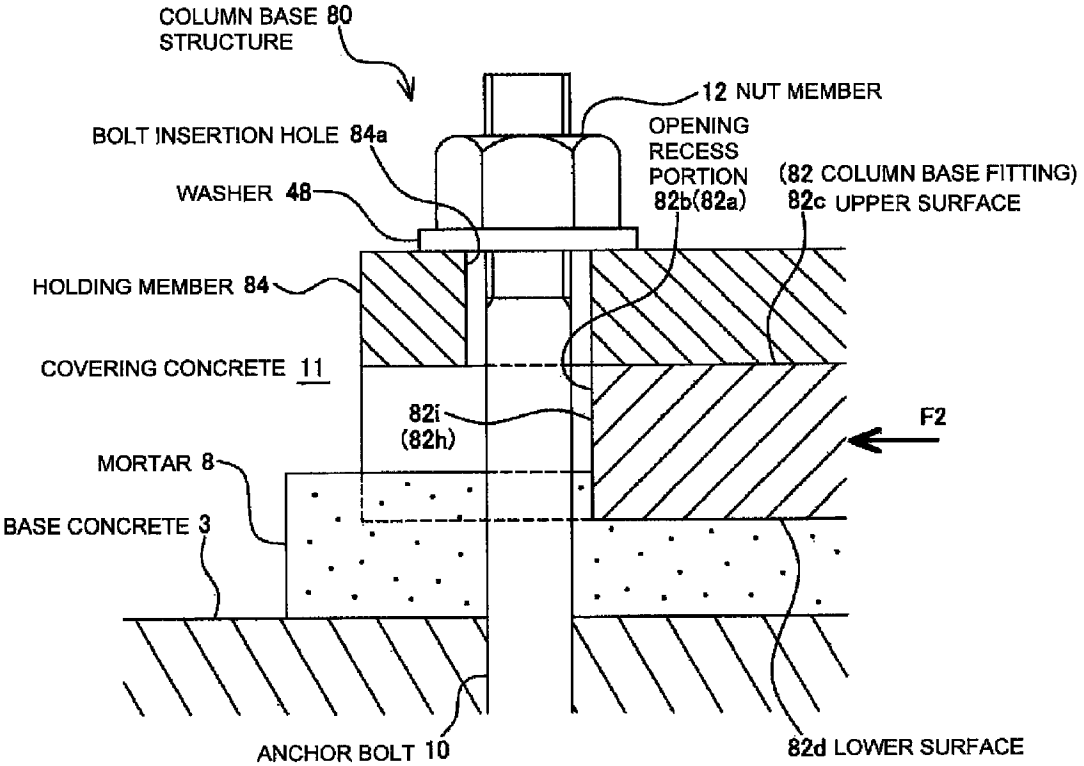
FIG. 25 is a partially enlarged cross-sectional view illustrating the joint part of the anchor bolt 10 and the column base structure 82 illustrated in FIG. 20.

Namely, as illustrated in FIG. 25, the mortar 8 filled between the lower surface 82*d* of the column base fitting 82 and the base concrete 3 closely contacts with the circular arc portions 82*h* and 82*i* of the opening recess portions 82*a* and 82*b*, and two side surfaces continuing to the circular arc portions 82*h* and 82*i*. Further, the mortar 8 is filled between the holding member 84 and the base concrete 3 so as to closely contacts with a part of the outer periphery surface of the anchor bolt 10 inserted in the circular arc portions 82*h* and 82*i* of the opening recess portions 82*a* and 82*b*.

In the part of upper side in the figure, which is between the holding member 84 and the base concrete 3 and not filled with mortar 8, the covering concrete 11 is filled.

Therefore, as illustrated in FIG. 25, when the horizontal force F2 toward the left direction in the figure is applied to column base fitting 82, the horizontal force F2 is transmitted to several anchor bolts 10 corresponding to the horizontal force F2 by pushing the several anchor bolts 10 on the downstream side of the direction of the horizontal force F2. The horizontal force F2 generates when the shearing force acts to the steel column 4 due to earthquake, etc. The horizontal force F2 is transmitted through the mortar 8 and the covering concrete 11, by which the circular arc portions 82*h* and 82*i* of the opening recess portions 82*a* and 82*b* of the column base fitting 82 and two side surfaces continuing to the circular arc portions 82*h* and 82*i*, push the several anchor bolts 10 respectively.

Then, the several anchor bolts 10 exert resistance force to the horizontal force F2, so that it can be prevented that the column base fitting 82 shifts in the horizontal direction with respect to the base concrete 3.

Furthermore, since the anchor bolts 10 receive the horizontal force F2 applied to the column base fitting 82 and exhibits the resistance force, it can be prevented that the mortar 8 and the covering concrete 11 are broken, in comparison with the case that only the mortar 8 and the covering concrete 11 directly receive the horizontal force F2.

Further, the opening recess portion 82*a* and 82*b* are notched in such a manner as to enter to have the approximately U shape. Thus, the mortar 8 and the covering concrete 11 can be easily filled between the holding member 64 and the base concrete 3.

Figure 26:
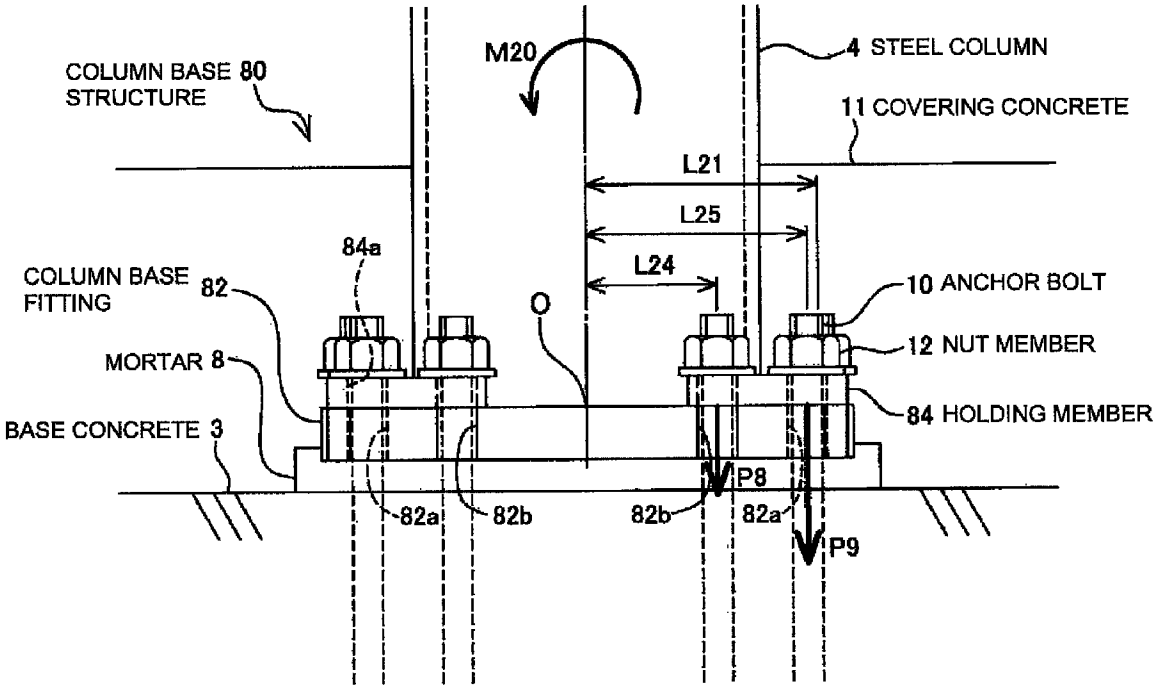
FIG. 26 is a view for explaining a state in which the bending moment M20 is applied in the column base structure 80 illustrated in FIG. 20.

In the column base structure 80 according to the present exemplary embodiment, as illustrated in FIG. 26, when the load generating large bending moment M20 is applied to the steel column 4 of the column base structure 80 by for example, an earthquake, etc., tensile loads P9 and P8 generate as a reaction force to prevent to lift up the right side in the figure in the column base fitting 82 by the bending moment M20. The large bending moment M20 is generated around the rotation center O of the joint portion with the column base fitting 82 in the anti-clockwise direction.

In the conventional column base structure 2, the tensile load P2 generates in the anchor bolt 10, which is inserted and fixed in the bolt insertion hole 6*b* and positioned apart by the length L2 from the rotation center O of the steel column 4 in FIG. 28. In the column base structure 80 according to the present exemplary embodiment, the tensile load P8 generates in the anchor bolt 10, which is inserted and fixed in the opening recess portion 82*b* of the column base fitting 82 and the bolt insertion hole 84*a* of the holding member 84, and positioned apart by the length L24 from the rotation center O of the steel column 4 in FIG. 26. The length L24 is longer than the length L2, so that the tensile load P8 is considerably larger than the tensile load P2.

Therefore, the flexural capacity of the column base structure 80 with respect to the bending moment M20 can be considerably large in comparison with the conventional column base structures 2 and 20 as a whole.

In the column base structure 80 according to the present exemplary embodiment, as illustrated in FIGS. 21 and 23, the center position of the circular arc portion 82*h* of the opening recess portion 82*a* of the column base fitting 82 is located at a position shifted close to the corner part 4*a* of the steel column 4 (close to the center of the column base fitting 82) from a cross point position of two lines (the position apart by the length L21 from the imaginary lines X2 and Y2 in FIG. 23). One line passes the center positions of two circular arc portions 82*i* of the opening recess portions 82*b* formed at two places in the length direction in one side of the column base fitting 82. Another line passes the center positions of two circular arc portions 82*i* of the opening recess portions 82*b* formed at two places in the length direction in an adjacent side to the one side in the perpendicular direction of the column base fitting 82.

The each center position of the circular arc portions 82*h* of the four opening recess portion 82*a* located at the four corner portions of the column base fitting 82 is located at the position shifted close to the corner part 4*a* of the steel column 4 from the cross point. Taking such a constitution, the rigidity of the column base fitting 82 becomes higher than the case that the center position of the circular arc portion 82*h* of the opening recess portion 82*a* is located at the cross point. Thus, considering the increase of the rigidity, the thickness of the column base fitting 82 can be thinned.

Figure 27:
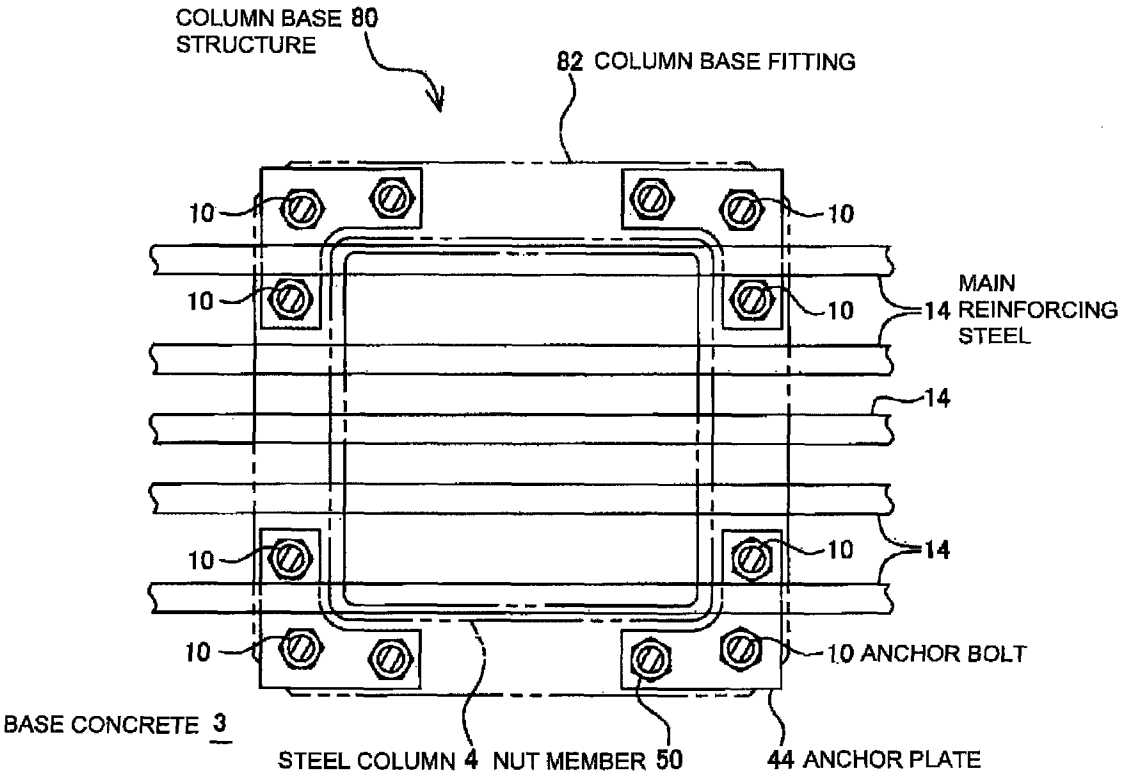
FIG. 27 is a cross-sectional view taken along a line E-E in the column base structure 80 illustrated in FIG. 20.

Further, in the column base structure 80 according to the present exemplary embodiment, when the main reinforcing steel 14 extending in the lateral direction in the figure is arranged in FIG. 27, a predetermined interval is formed between the anchor bolts 10 and 10 inserted in the opening recess portions 82*b* and 82*b*, in the each side extending in the vertical direction of the column base fitting 82 in FIG. 21.

Thus, by the same reason as the column base structure 40 according to the first exemplary embodiment, the arrangement of the main reinforcing steel 14 can be easily performed.

Further, by the same reason as the column base structure 40 according to the first exemplary embodiment, many reinforcing steels 14 can be arranged between the anchor bolts 10.

Therefore, as described above, in the column base fitting 82 according to the present exemplary embodiment and the column base structure 80 using it, the flexural capacity of the entirety of the column base structure 80 can be increased and the increase of size, weight, and cost of the column base fitting 82 can be prevented. In addition, the efficiency of the installation operation of the column base structure 80 can be increased.

In addition, in the column base structures 40, 60, and 80 according to the first to the third exemplary embodiments, the column base fittings 42, 62, and 82 have a square shape but can have another rectangular shape having different lengths in the vertical and the horizontal directions.

Further, in the column base structure 40 according to the first exemplary embodiment, as illustrated in FIG. 5, the center position of the bolt insertion hole 42*a* of the column base fitting 42 is located at the position shifted close to the corner part 42*q* of the support base 42*f* from the cross point position by two lines. One line passes center positions of two bolt insertion holes 42*b* formed at two positions in the length direction of one side of the bottom plate 42*c*. Another line passes two center positions of the bolt insertion holes 42*b* formed at two positions in the length direction of the adjacent side in the perpendicular direction to the one line. However, the center position of the bolt insertion hole 42*b* can be located at the cross point position.

Similarly, in the column base structure 60 according to the second exemplary embodiment, as illustrated in FIG. 15, the center position of the bolt insertion hole 62*a* of the column base fitting 62 is located at the position shifted close to the corner part 4*a* of the steel column 4 from the cross point position by two lines. One line passes center positions of two bolt insertion holes 62*b* formed at two positions in the length direction in one side of the column base fitting 62. Another line passes center positions of two bolt insertion holes 62*b* formed at two positions in the length direction in the adjacent side in the perpendicular direction to the one line. However, the center position of the bolt insertion hole 62*b* can be located at the cross point position.

Furthermore, in the column base structure 80 according to the third exemplary embodiment, as illustrated in FIG. 23, the center position of the opening recess portion 82*a* of the column base fitting 82 is located at the position shifted close to the corner part 4*a* of the steel column 4 from the cross point position by two lines. One line passes center positions of two circular arc portions 82*i* formed at two positions in the length direction in one side of the column base fitting 82. Another line passes center positions of two circular arc portions 82*i* formed at two positions in the length direction in the adjacent side in the perpendicular direction to the one line. However, the center position of the circular arc portion 82*i* of the opening recess portion 82*a* can be located at the cross point position.

Further, in the column base fitting 82 according to the third exemplary embodiment, as illustrated in FIG. 23, the opening recess portions 82*a* and 82*b* are formed to have an approximately U shape having the circular arc portions 82*h* and 82*i* having a semicircular shape at the innermost part. However, the shape is not limited in this shape. Any shapes are possible if the upper end of the anchor bolt 14 can be inserted in the each circular portion of the opening recess portions 82*a* and 82*b* from a lower side to an upper side.

Further, in the column base fitting 42 according to the first exemplary embodiment, as illustrated in FIG. 7, the step recess portion 42*m* is formed at each four corners of the lower surface 42*e* of the bottom plate 42*c*. However, the present invention can apply a column base fitting in which the step recess portion 42*m* is not provided any corner portions of the lower surface 42*e* of the bottom plate 42*c*. Similarly, in the column base fitting 62 according to the second exemplary embodiment, the step recess portion 62*e* is formed in each four corner portions of the lower surface 62*d*. However, the present invention can apply a column base fitting in which the step recess portion 62*e* is not provided any corner portions of the lower surface 62*d*.

Further, in the protrusion portions 42*r* and 42*s* in the column base fitting 42 according to the first exemplary embodiment, as illustrated in FIGS. 3, 4, and 9, the apexes H and Q are located at the intermediate position of the height of the side surface 42*h* of the support base 42*f*. However, the apexes H and Q can be located at the top end position of the height of the side surface 42*h* of the support base 42*f*.

Further, as illustrated in FIGS. 3 and 9, the ridge lines 42*v* and 42*y* of the protrusion portions 42*r* and 42*s* are formed inclining approximately 45 degrees from the apexes J and S on the upper surface 42*d* of the bottom plate 42*c*. However, the ridge lines 42*v* and 42*y* can be formed inclining any angles other than 45 degrees.

Further, in the column base fittings 42, 62, and 82 according to the exemplary embodiments the first to the third, as illustrated in FIGS. 11, 19, and 27 respectively, the anchor plate 44 is formed to be the L-shaped plate. However, the anchor plate 44 can be formed to be one anchor plate having a quadrangular shape. In such a case, all 12 anchor bolts 10 can be fixed in the one anchor plate. In another case, each one anchor plate can be fixed to one anchor bolt 10.

Further, in the column base structures 40, 60, and 80 according to the exemplary embodiments the first to the third, three main reinforcing steels 14 are arranged between the anchor bolts 10 and 10, which are inserted in two bolt insertion holes 42*b*, two insertion holes 62*b*, and two opening recess portions 82*b* in one side. If possible, four or more main reinforcing steels 14 can be arranged between the anchor bolts 10 and 10.

Further, if possible, two or more main reinforcing steels 14 can be arranged respectively between the anchor bolts 10 inserted in the bolt insertion holes 42*a* and 62*a*, and the opening recess portions 82*a* and the anchor bolt 10 inserted in the bolt insertion holes 42*b* and 62*b*, and the opening recess portion 82*b*.

Further, in the column base structure 40 according to the first exemplary embodiment, the steel column 4, in which the lower end surface thereof is jointed to the column base fitting 42, is formed to be the rectangular tube. However, the shape of the steel column 4 is not limited in this shape and, for example, a circular tube can used. Further, the shape of the support base 42*f* of the column base fitting 42 can be changed corresponding to the shape of the steel column 4.

When the shape of the support base 42*f* is changed to a circular tube, in the horizontal cross section of the column base structure 40, a part on the outer periphery surface of the circular shape of the support base 42*f*, which is the shortest distance from the center position of the bolt insertion hole 42*a*, can be regarded as the corner part 42*q* in the invention according to the first exemplary embodiment.

Similarly, in the column base structures 60 and 80 according to the second and the third exemplary embodiments, the steel column 4 in which the lower end surface thereof is jointed on the upper surfaces 62*c* and 82*c* of the column base fitting 62 and 82 is formed to the rectangular tube. However, the shape of the steel column 4 is not limited in this shape and, for example, a circular tube can used.

When the shape of the steel column 4 is change to the circular tube, in the horizontal cross section of the column base structure 60, a part on the outer periphery surface of the circular shape of the steel column 4, which is the shortest distance from the center position of the bolt insertion hole 62*a*, can be regarded as the corner part 4*a* in the invention according to the second exemplary embodiment. Similarly, when the shape of the steel column 4 is change to the circular tube, in the horizontal cross section of the column base structure 80, a part on the outer periphery surface of the circular shape of the steel column 4, which is the shortest distance from the center position of the circular arc portion 82*h* of the opening recess portion 82*a*, can be regarded as the corner part 4*a* in the invention according to the third exemplary embodiment.

Further, in the column base structures 60 and 80 according to the second and the third exemplary embodiments, the covering concrete 11 is formed on the base concrete 3. However, the invention according to the second and the third exemplary embodiments can be applied to a column base structure in which the covering concrete 11 is not formed on the base concrete 3.

When the covering concrete is not formed, it is preferable that the female parts of the two nut members 12 are screwed (double nuts) on the male part formed on the top end of the anchor bolt 10, for preventing to be loose in screwing the anchor bolt 10 and the nut member 12.

EXPLANATION OF REFERENCE NUMERALS

2: column base structure
3: base concrete
4: steel column
6: column base fitting
6*a*, 6*b*: bolt insertion hole
8: mortar
10: anchor bolt
11: covering concrete
12: nut member
14: main reinforcing steel
20: column base structure
22: column base fitting
22*a*, 22*b*: bolt insertion hole
40: column base structure
42: column base fitting
42*a*, 42*b*: bolt insertion hole
42*c*: bottom plate
42*d*: upper surface
42*e*: lower surface
42*f*: support base
42*g*: upper surface
42*h*: side surface
42*i*: recess portion
42*j*: inclination recess portion
42*k*: corner portion external surface
42*m*: step recess portion
42*n*: boundary step surface
42*o*: recess plane
42*p*: corner portion external surface
42*q*: corner part
42*r*, 42*s*: protrusion portion
42*t*, 42*u*: ridge side portion
42*v*: ridge line
42*w*, 42*x*: ridge side portion
42*y*: ridge line
44: anchor plate
44*a*: through hole
46: nut member
48: washer
60: column base structure
62: column base fitting
62*a*, 62*b*: bolt insertion hole
62*c*: upper surface
62*d*: lower surface
62*e*: step recess portion
62*f*: boundary step surface
62*g*: recess plane
62*h*: corner surface
80: column base structure
82: column base fitting
82*a*, 82*b*: opening recess portion
82*c*: upper surface
82*d*: lower surface
82*h*, 82*i*: circular arc portion
82*j*: corner surface
84: holding member
84*a*: bolt insertion hole
84*b*: corner surface
F, F1, F2: horizontal force
G, G1, G2, G3, G4, G5: gravity center
H, I, J, K: apex
L, L10, L20: distance
L1, L2, L3, L4, L5: length
L11, L14, L15, L21, L24, L25: length
M, M1, M10, M11, M20, M21: bending moment
O: rotation center
P1, P2, P3, P4, P5, P6, P7, P8, P9: tensile load
Q, R, S: apex
T, T1, T2: tensile load
t, t1, t2: thickness
U: apex
X, Y, X1, X2, Y1, Y2: imaginary line

What is claimed is:

1. A column base fitting comprising:

a bottom plate formed to be a plate shape having a square shape, both surfaces of upper and lower, and thickness, and;

a support base being inside from a periphery part of the upper surface of the bottom plate and having a height upward, wherein an upper surface of the support base is configured to be jointed on a lower end of a column member, wherein three bolt insertion holes are formed in each four corner portions of the bottom plate, wherein each center position of the three bolt insertion holes is located at a position, in which a gravity center of a triangle consisting of lines connecting each center of the bolt insertion holes comes to a position corresponding to a corner part of the support base, and wherein each of said three bolt insertion holes is formed to have approximately the same diameter, wherein the three bolt insertion holes are a first bolt insertion hole formed in each four corner portions of the bottom plate and second bolt insertion holes formed at positions closer to a center part than the first bolt insertion hole in each two adjacent sides to the corner portion, and wherein a step recess portion lower than a height of the bottom plate is formed on a lower surface side of the bottom plate and outside in the horizontal direction from the second bolt insertion hole.

2. The column base fitting according to claim 1, wherein a center position of the first bolt insertion hole is located at a position shifted close to the corner part of the support base from a cross point of two lines, wherein one line passes two centers of the second bolt insertion holes formed at two positions in the length direction of one side of the bottom plate, and wherein another line passes two centers of the second bolt insertion holes formed at two positions in the length direction of another adjacent side to the one side in the perpendicular direction.

3. The column base fitting according to claim 2, wherein a protrusion portion protruding outside in the perpendicular direction from a side surface near a corner part of the support base is formed.

4. The column base fitting according to claim 1, wherein a protrusion portion protruding outside in the perpendicular direction from a side surface near a corner part of the support base is formed.

5. The column base fitting according to claim 1, wherein said step recess portion has a recess plane recessed toward the upper surface of the bottom plate at each four corner portions of the lower surface of the bottom plate, and wherein a boundary step surface is formed at a step portion of the recess plane of the step recess portion and the lower surface of the bottom plate such that a center part of a length thereof contacts an inner periphery surface of the second bolt insertion hole and both end parts of the length thereof extend outward.

6. A column base fitting formed to be a plate shape having a square shape, both surfaces of upper and lower, and thickness, wherein the upper surface thereof is configured to be jointed on a lower end of a column member, wherein three bolt insertion holes are formed in each four corner portions of the square shape, and wherein each center position of the three bolt insertion holes is located at a position in which a gravity center of a triangle consisting of lines connecting each center of the three bolt insertion holes comes to a position corresponding to a corner part of the column member, and wherein each of said three bolt insertion holes is formed to have approximately the same diameter;

wherein the three bolt insertion holes are a first bolt insertion hole formed in each four corner portions and second insertion holes formed at positions closer to a center part than the first bolt insertion hole in each two adjacent sides to the corner portion, and wherein a step recess portion having a height lower than a height from the upper surface to the lower surface is formed in the lower surface side of the column base fitting and outside in the horizontal direction from the second bolt insertion hole.

7. The column base fitting according to claim 6, wherein a center position of the first bolt insertion hole is located at a position shifted close to the center of the square shape from a cross point of two lines, wherein one line passes two centers of the second bolt insertion holes formed at two positions in the length direction of one side of the square shape, and wherein another line passes two centers of the second bolt insertion holes formed at two positions in the length direction of another adjacent side to the one side in the perpendicular direction.

8. A column base fitting formed to be a plate shape having a square shape, both surfaces of upper and lower, and thickness, wherein the upper surface of the column base fitting is configured to be jointed on a lower end of a column member, and the column base fitting is fixed upward on a base concrete by a holding member placed on the upper surface thereof, wherein three notch portions are formed in each four corner portions of the square shape, and wherein each center position of the three notch portions is located at a position in which a gravity center of a triangle consisting of lines connecting each center of three circular arc portions comes to a position corresponding to a corner part of the column member, and wherein each circular arc portion having a semi-circular shape of the three notch portions is formed to have approximately the same diameter.

9. The column base fitting according to claim 8, wherein the three notch portions are formed to be approximately U shape having a circular arc portion at innermost part thereof.

10. The column base fitting according to claim 9, wherein the three notch portions are a first notch portion formed in each four corner portions, and second notch portions formed at positions shifted close to a center part than the first notch portion in each two adjacent sides to the corner portion.

11. The column base fitting according to claim 10, wherein a center position of the circular arc portion of the first notch portion is located at a position shifted close to a center portion of the square shape from a cross point of two lines, wherein one line passes two centers of the circular arc portions of the second notch portions formed at two positions in the length direction of one side of the square shape, and wherein another line passes two centers of the circular arc portions of the second notch portions formed at two positions in the length direction of another adjacent side to the one side in the perpendicular direction.

12. The column base fitting according to claim 8, wherein the three notch portions are a first notch portion formed in each four corner portions, and second notch portions formed at positions shifted close to a center part than the first notch portion in each two adjacent sides to the corner portion.

13. The column base fitting according to claim 12, wherein, a center position of the circular arc portion of the first notch portion is located at a position shifted close to a center portion of the square shape from a cross point of two lines, wherein one line passes two centers of the circular arc portions of the second notch portions formed at two positions in the length direction of one side of the square shape, and fragile wherein another line passes two centers of the circular arc portions of the second notch portions formed at two positions in the length direction of another adjacent side to the one side in the perpendicular direction.

14. A column base structure comprising a column base fitting formed to be a plate shape having a square shape, both surfaces of upper and lower, and thickness, wherein the upper surface of the column base fitting is configured to be jointed on a lower end of a column member, and wherein the column base fitting is fixed upward on the base concrete by a holding member placed on the upper surface thereof, and wherein in the column base fitting, three notch portions are formed in each four corner portions of the square plate shape, and wherein each center position of the three notch portions is located at a position in which a gravity center of a triangle consisting of lines connecting each center of the three circular arc portions comes to a position corresponding to the corner part of the column member, and wherein each circular arc portion having a semi-circular shape of the three notch portions is formed to have approximately the same diameter.

15. The column base structure according to claim 14, wherein the column base fitting is provided upward on the base concrete, and anchor bolts protruding upward from the base concrete are inserted in each three notch portions, and wherein the holding member is fixed on the column base fitting by the anchor bolts inserted in the three notch portions.

16. A column base fitting comprising:

a bottom plate formed to be a plate shape having a square shape, both surfaces of upper and lower, and thickness, and;

a support base being inside from a periphery part of the upper surface of the bottom plate and having a height upward, wherein an upper surface of the support base is configured to be jointed on a lower end of a column member, wherein three bolt insertion holes are formed in each four corner portions of the bottom plate, wherein each center position of the three bolt insertion holes is located at a position, in which a gravity center of a triangle consisting of lines connecting each center of the bolt insertion holes comes to a position corresponding to a corner part of the support base, wherein each of said three bolt insertion holes is formed to have approximately the same diameter, and wherein said bottom plate has an inclination recess portion formed at a center part in a length direction of each four sides of the bottom plate such that a height of the bottom plate decreases gradually as approaching to an outer side surface of side part from a height of an inside of the upper surface of the bottom plate.

17. A column base fitting comprising:

a bottom plate formed to be a plate shape having a square shape, both surfaces of upper and lower, and thickness, and;

a support base being inside from a periphery part of the upper surface of the bottom plate and having a height upward, wherein an upper surface of the support base is configured to be jointed on a lower end of a column member, wherein three bolt insertion holes are formed in each four corner portions of the bottom plate, wherein each center position of the three bolt insertion holes is located at a position, in which a gravity center of a triangle consisting of lines connecting each center of the bolt insertion holes comes to a position corresponding to a corner part of the support base, wherein each of said three bolt insertion holes is formed to have approximately the same diameter, wherein the three bolt insertion holes are a first bolt insertion hole formed in each four corner portions of the bottom plate and second bolt insertion holes formed at positions closer to a center part than the first bolt insertion hole in each two adjacent sides to the corner portion, wherein a protrusion portion protruding outside in the perpendicular direction from a side surface near a corner part of the support base is formed, and wherein said protrusion portion is formed such that a length in the shortest distance from the center position of the second bolt insertion hole is set to be a same length from the lower end position in height of the corner part of the support base to the center position of the first bolt insertion hole.

* * * * *